US010673147B2

(12) United States Patent
Sikes et al.

(10) Patent No.: US 10,673,147 B2
(45) Date of Patent: Jun. 2, 2020

(54) DIRECTIONAL COUPLER FEED FOR FLAT PANEL ANTENNAS

(71) Applicants: Benjamin Sikes, Seattle, WA (US); Erik Shipton, Kirkland, WA (US); David Levesque, Redmond, WA (US); Mohsen Sazegar, Kirkland, WA (US); Ryan Stevenson, Woodinville, WA (US); Chris M. Eylander, Seattle, WA (US)

(72) Inventors: Benjamin Sikes, Seattle, WA (US); Erik Shipton, Kirkland, WA (US); David Levesque, Redmond, WA (US); Mohsen Sazegar, Kirkland, WA (US); Ryan Stevenson, Woodinville, WA (US); Chris M. Eylander, Seattle, WA (US)

(73) Assignee: KYMETA CORPORATION, Redmond, WA (US)

( * ) Notice: Subject to any disclaimer, the term of this patent is extended or adjusted under 35 U.S.C. 154(b) by 0 days.

(21) Appl. No.: 15/802,320

(22) Filed: Nov. 2, 2017

(65) Prior Publication Data

US 2018/0123260 A1 May 3, 2018

Related U.S. Application Data

(60) Provisional application No. 62/416,907, filed on Nov. 3, 2016.

(51) Int. Cl.
*H01Q 13/00* (2006.01)
*H01Q 21/00* (2006.01)
(Continued)

(52) U.S. Cl.
CPC ..... *H01Q 21/0056* (2013.01); *H01Q 1/1285* (2013.01); *H01Q 5/15* (2015.01);
(Continued)

(58) Field of Classification Search
CPC ..... H01Q 13/103; H01Q 15/0006; H01Q 15/0053; H01Q 1/1285; H01Q 1/38;
(Continued)

(56) References Cited

U.S. PATENT DOCUMENTS 2,628,311 A * 2/1953 Lindenblad ..... H01Q 13/10 343/771
2,650,985 A * 9/1953 Rust ..... H01Q 13/02 343/786
(Continued)

OTHER PUBLICATIONS

International Preliminary Report on Patentability for Application No. PCT/US2017/060001 dated May 16, 2019, 10 pages.
(Continued)

*Primary Examiner* — Tho G Phan
(74) *Attorney, Agent, or Firm* — Womble Bond Dickinson (US) LLP

(57) ABSTRACT

Antennas such as flat panel, leaky wave antennas with directional coupler feeds and waveguides are disclosed. In one example, an antenna includes a surface having antenna elements, a guided wave transmission line, and a coupling surface. The guided wave transmission line provides a guided feed wave. The coupling surface is between and separates the guided wave transmission line and the surface having antenna elements. The coupling surface controls coupling of the guided feed wave to the antenna elements. The coupling surface can also spatially filter the guided feed wave to provide a more uniform power density for the antenna elements. The guided feed wave can be a high power density electromagnetic wave or a density radially decaying electromagnetic wave.

20 Claims, 25 Drawing Sheets

(51) Int. Cl.

| | |
|---|---|
| ***H01Q 15/00*** | (2006.01) |
| ***H01Q 21/06*** | (2006.01) |
| ***H01Q 5/15*** | (2015.01) |
| ***H01Q 1/12*** | (2006.01) |
| ***H01Q 9/28*** | (2006.01) |
| *H01Q 13/10* | (2006.01) |

(52) U.S. Cl.
CPC ..... *H01Q 9/28* (2013.01); *H01Q 15/0006* (2013.01); *H01Q 15/0053* (2013.01); *H01Q 21/0012* (2013.01); *H01Q 21/064* (2013.01); *H01Q 13/103* (2013.01); *H01Q 21/0075* (2013.01)

(58) Field of Classification Search
CPC ..... H01Q 9/04; H01Q 11/02; H01Q 13/00; H01Q 21/00; H01Q 21/21; H01Q 21/0012; H01Q 21/005; H01Q 21/0056; H01Q 21/0075; H01Q 21/064; H01Q 5/15; H01Q 9/28; H01Q 13/21; A61K 9/00; A61M 37/00
See application file for complete search history.

(56) References Cited

U.S. PATENT DOCUMENTS

| | | | | |
|---|---|---|---|---|
| 2,867,778 | A * | 1/1959 | Hafner | H01P 5/08 333/33 |
| 2,912,695 | A * | 11/1959 | Cutler | H01J 25/74 343/781 R |
| 3,022,506 | A * | 2/1962 | Goebels, Jr. | H01Q 21/0012 221/12 |
| 3,243,818 | A * | 3/1966 | Holtzman | H01Q 21/005 221/5 |
| 6,320,547 | B1 * | 11/2001 | Fathy | H01Q 1/38 333/262 |
| 8,836,594 | B2 | 9/2014 | Rothwell et al. | |
| 2003/0011517 | A1 | 1/2003 | Kolat et al. | |
| 2009/0315796 | A1 | 12/2009 | Kodama | |
| 2012/0194400 | A1 * | 8/2012 | Brasile | H01Q 21/067 343/776 |
| 2013/0285871 | A1 | 10/2013 | Gregoire | |
| 2015/0236415 | A1 | 8/2015 | Bily et al. | |

OTHER PUBLICATIONS

PCT Application No. PCT/US2017/060001, Notification of Transmittal of the International Search report and the Written Opinion, dated Feb. 14 2018, 12 pgs.

International Preliminary Report on Patentability for International Application No. PCT/US2017/060001, dated May 7, 2019, 8 pages.

* cited by examiner

DIRECTIONAL COUPLER FEED FOR FLAT PANEL ANTENNAS

PRIORITY

This application claims priority and the benefit of U.S. Provisional Patent Application No. 62/416,907, entitled "DIRECTIONAL COUPLER FEED," filed on Nov. 3, 2016, which is hereby incorporated by reference and commonly assigned.

FIELD

Examples and embodiments of the invention are in the field of communications including satellite communications and antennas. More particularly, examples and embodiments of the invention are related to directional coupler feeds for flat panel antennas.

BACKGROUND

Satellite communications involve transmission of electromagnetic waves. Electromagnetic waves can have small wavelengths and be transmitted at high frequencies in the gigahertz (GHz) range. Satellite antennas can produce focused beams of high-frequency electromagnetic radiation that allow for point-to-point communications having broad bandwidth and high transmission rates. One type of satellite antenna is a flat panel antenna. This type of antenna includes a number of panels or segments having dipoles or other radiating elements to receive and transmit electromagnetic waves. If the antenna elements are fed in series or if the antenna elements are distributed along the length of the feeding waveguide, as with a periodic leaky wave antenna, the feeding wave propagates along the aperture or area of a flat panel antenna and the power density distribution decays along the aperture as a result of radiation by the antenna elements. The power density distribution across the aperture of the antenna is desired to be as uniform as possible in order to maximize the aperture efficiency of the antenna.

SUMMARY

Antennas such as flat panel, leaky wave antennas with directional coupler feeds and waveguides are disclosed. In one example, an antenna includes a surface having antenna elements, a guided wave transmission line, and a coupling surface. The guided wave transmission line provides a guided feed wave. The coupling surface is between and separates the guided wave transmission line and the surface having antenna elements. The coupling surface is to control coupling of the guided feed wave to the antenna elements. The coupling surface can control vertical coupling or lateral coupling of the guided feed wave to the antenna elements. The coupling surface can also spatially filter the guided feed wave to provide a more uniform power density and, thus, a more uniform excitation to the antenna elements. The guided feed wave can be a high-power-density electromagnetic wave or a high-power-density, radially decaying electromagnetic wave.

In one example, the antenna elements can be scattering antenna elements and the surface can be a scattering surface for the antenna. In one example, the guided wave transmission line can be part of an edge-fed cylindrical waveguide, a center-fed cylindrical waveguide, a linear waveguide, or a stripline transmission line. The waveguides can include a top waveguide and a bottom waveguide. In one example, a power density in the bottom waveguide can feed into the top waveguide through the coupling surface to compensate for power decay in the top guide.

Other antennas, methods, systems and coupler feeds are described.

BRIEF DESCRIPTION OF THE DRAWINGS

The present invention will be understood more fully from the detailed description given below and from the accompanying drawings of various examples and examples which, however, should not be taken to the limit the invention to the specific examples and examples, but are for explanation and understanding only.

DETAILED DESCRIPTION

Examples and embodiments are disclosed for antennas such as flat panel, leaky wave antennas with directional coupler feeds and waveguides. In one example, an antenna includes a surface having antenna elements, a guided wave transmission line, and a coupling surface. The guided wave transmission line provides a guided feed wave. The coupling surface is between and separates the guided wave transmission line and the surface having antenna elements. The coupling surface is configured to control coupling of the guided feed wave to the antenna elements. In one example, the coupling surface can control vertical coupling or lateral coupling of the guided feed wave to the antenna elements. The coupling surface can spatially filter the guided feed wave to provide a more uniform power density and, thus, a more uniform excitation to the antenna elements. The guided feed wave can be a high-power-density electromagnetic wave or a high-power-density, radially decaying electromagnetic wave.

In one example, the antenna elements can be scattering antenna elements and the surface can be a scattering surface for the antenna. In various embodiments, the guided wave transmission line can be part of an edge-fed cylindrical waveguide, a center-fed cylindrical waveguide, a linear waveguide, or a stripline transmission line. The waveguides can include a top waveguide and a bottom waveguide. In one example, an electromagnetic wave in the bottom waveguide can feed into the top waveguide through the coupling surface to compensate for power decay in the top guide.

In the following description, numerous details are set forth to provide a more thorough explanation of the present invention. It will be apparent, however, that the present invention may be practiced without these specific details. In other instances, well-known structures and devices are shown in block diagram form, rather than in detail, in order to avoid obscuring the present invention.

Some portions of the detailed description that follow are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

Example Antennas with Directional Coupler

Figure 1:
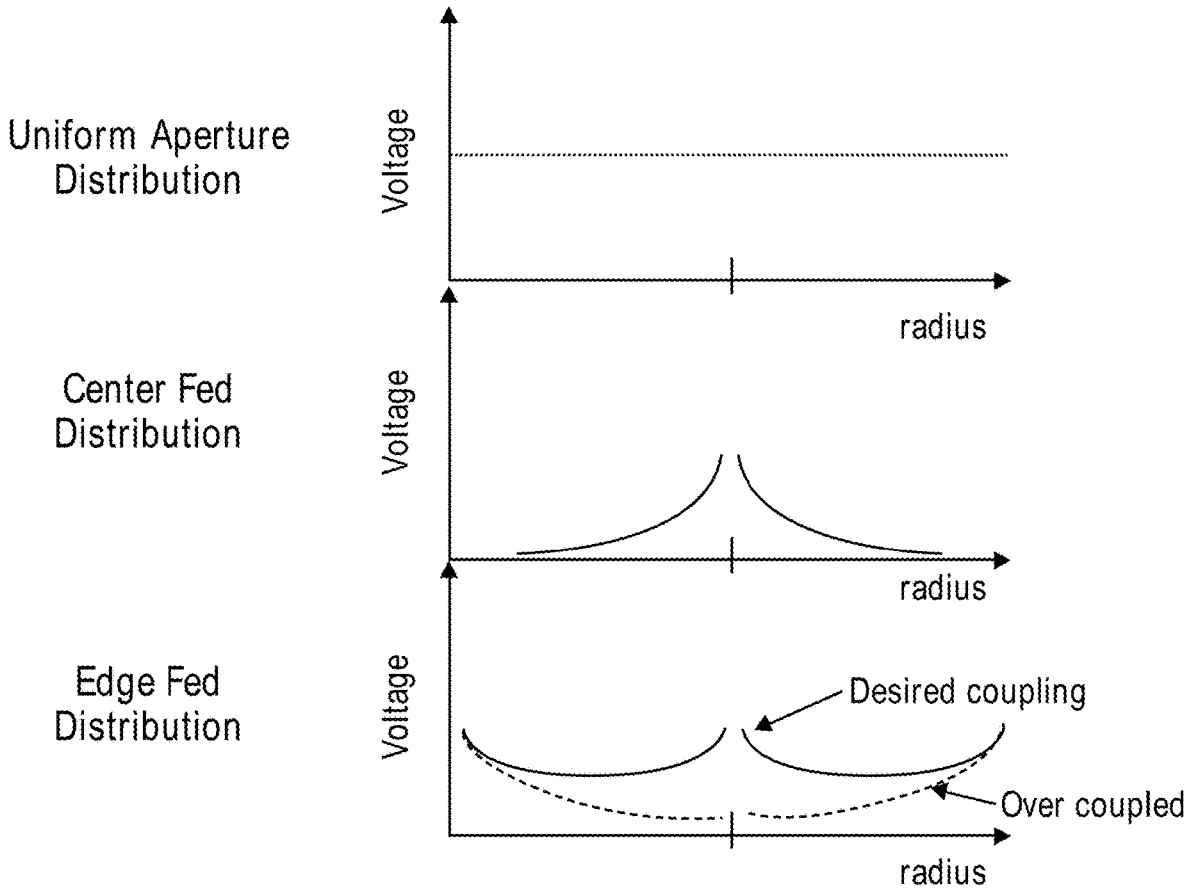
FIG. 1 illustrates examples of uniform aperture power distribution, center fed aperture distribution, and edge fed aperture distribution.
Figure 10A:
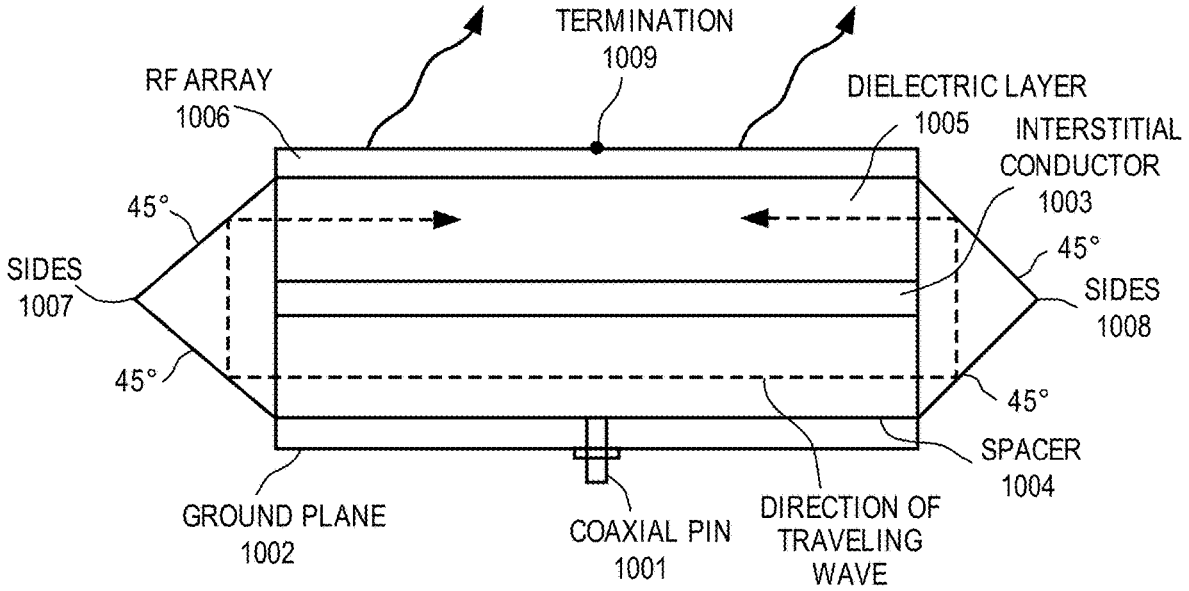
FIG. 10A illustrates a side view of one example of a cylindrically fed antenna structure.
Figure 10B:
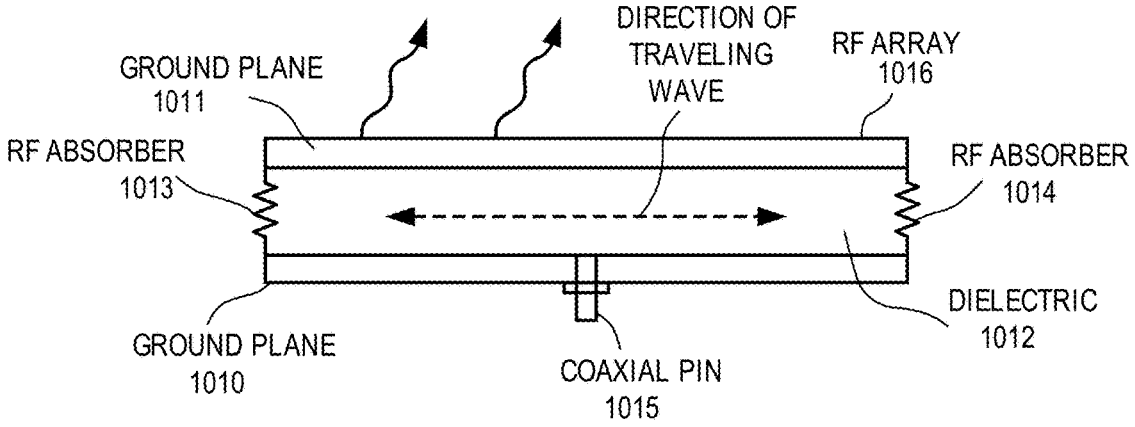
FIG. 10B illustrates another example of the antenna system with a cylindrical feed producing an outgoing wave.

FIG. 1 illustrates examples of uniform aperture power distribution, center fed aperture distribution, and edge fed aperture distribution for radially fed antennas such as flat panel antennas. Radially fed antennas can have a center fed configuration or an edge fed configuration. For the center fed configuration, a center fed radio frequency (RF) wave or electromagnetic wave travels outwardly, and, for the edge fed configuration, the edge fed RF wave or electromagnetic wave travels inwardly. Such edge fed and center fed antenna configurations are illustrated in FIGS. 10A and 10B, respectively. Referring to FIG. 1, the top graph shows a uniform and ideal aperture distribution where the power density is weighted across the aperture uniformly, which maximizes the aperture to focus the electromagnetic radiation to antenna elements.

In the following examples and embodiments, antennas are disclosed for improved and more uniform aperture distribution having a directional coupler with a coupling surface. In the following examples, a coupling surface can control coupling of a guided feed wave in a transmission line or waveguide to antenna elements for vertical coupling or lateral coupling, and filter the guided feed wave to provide a more uniform power density for the antenna elements. The directional coupler with a coupling surface can be used with any type of waveguide such as an edge-fed cylindrical waveguide, a center-fed cylindrical waveguide, a linear waveguide, or a strip transmission line feed waveguide and not limited to any particular type of waveguide system for an antenna.

Directional Coupler with Coupling Surface

Figure 2A:
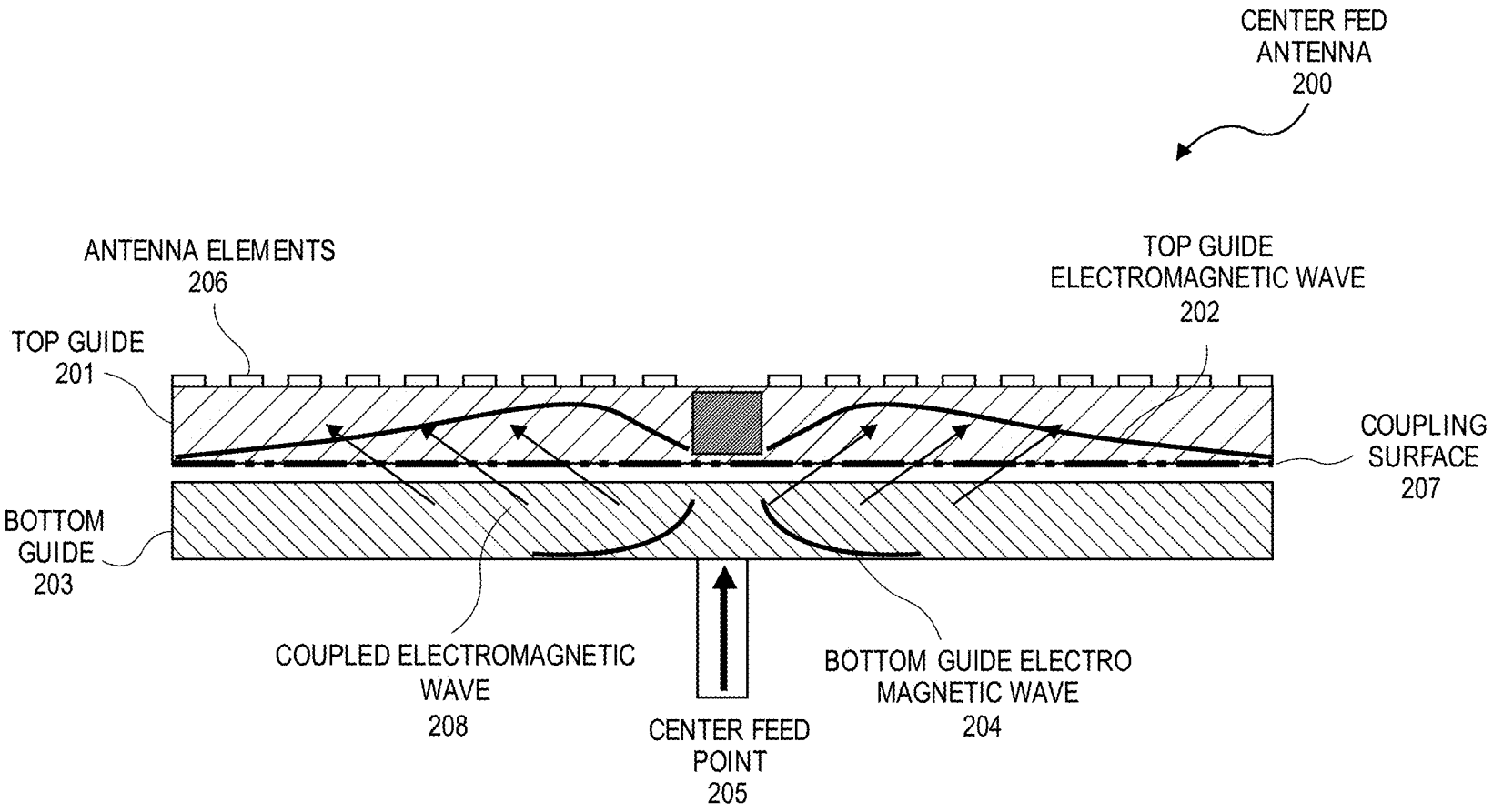
FIG. 2A illustrates one example of a cross-section view of a center fed antenna to provide an improved and more uniform aperture distribution.

FIG. 2A illustrates one example of a cross-sectional view of a center fed antenna 200 to provide an improved and more uniform aperture distribution. Center fed antenna 200 can provide a number of benefits including controllable aperture distribution with the ease of center feeding, which can be less complex to fabricate lowering costs without the need, e.g., of costly aluminum machined waveguides. Center fed antennas, as compared to edge-fed antennas, reduce the number of parts in the feed assembly, are more amendable to high-volume manufacturing techniques, and thus are less complex and costly to fabricate. The disclosed center fed antenna 200 can thus provide lower power loss and higher gain without over/under coupling.

Referring to FIG. 2A, center fed antenna 200 includes a layer of antenna elements 206 coupled or attached to top guide 201 and a bottom guide 203 receiving a center feed point 205. In one example, bottom guide 203 can be a guided transmission line to provide a guided feed wave from center feed point 205. In one example, coupling surface 207 (directional coupler) is between bottom guide 203 and top guide 201 and can separate the guided transmission line from the antenna elements. In one example, top guide 201 and bottom guide 203 are waveguides. In one example, top guide 201 can include a glass layer, foam layer, a plastic layer such as Rexolite. Bottom guide 203 can include a polymer layer and foam. Both top guide 201 and bottom guide 203 can include terminations at its ends to prevent resonances in the waveguides as shown by termination 211 in FIG. 2D. In one example, center feed point 205 is coupled or attached to bottom guide 203 and feeds an RF wave or electromagnetic wave to bottom guide 203, which can guide the feed wave for center fed antenna 200. In one example, center feed point 205 can form part of multiple dielectric stack-up as shown in FIG. 2E (center portion stack) in which injected molded plastic can hold the stack together. The center portion stack can have any number of different configurations layers and not limited to the example in FIG. 2E. In other examples, a metal can be used to hold the center stack for center feed point 205. Center fed antenna 200 with a directional coupler (coupling surface 207) can be used for the antenna feed in the examples and embodiments disclosed herein including FIGS. 5A-23B.

For the coupling surface 207 example in FIG. 2A, coupling surface 207 is between bottom guide 203 and antenna elements 206 which can be on a surface on top of top guide 201. In one example, coupling surface 207 separates top guide 201 and bottom guide 203. Coupling surface 207 can be configured to act and operate as directional coupler to control coupling of a guided feed wave in bottom guide 203 to antenna elements 206. In this example, coupling surface 207 can control vertical coupling of the guided feed wave to the antenna elements 206. In other examples, coupling surface 207 can control lateral coupling of a guided feed wave to antenna elements. In one example, coupling surface 207 can spatially filter the guided feed wave in bottom guide 203 to provide a more uniform aperture or power density distribution in the top guide 201 and provide a more uniform excitation of antenna elements 206 in antenna 200.

For example, coupling surface 207 (directional coupler) filters the high power density electromagnetic wave 204 in bottom guide 203 and presents that power density as a coupled wave 208 that feeds into top guide 201 to provide a more uniform top guide electric magnetic wave 202. In one example, a coupling surface 207 can include a ground plane with periodic coupling rings. The ground plane can be electro-deposited onto a plastic such as Rexolite or made of a large printed circuit board (PCB). In another example, coupling surface 107 can be a perforated grounded surface having openings. In one example, coupling surface 207 can replace an intermediate guide plate in existing antennas and can be a broadband coupler in which aperture distribution is not dependent on frequency. In one example, a coupling surface 207 (or directional coupler) can be configured to compensate for the reduction in power density caused by the spreading of the electromagnetic wave 204 while propagating in the radial direction. This effect is common to cylindrical waveguides.

In one example, coupled wave 208 of bottom guide 203 couples to top guide electromagnetic wave 202 thereby increasing power density along the length of the top guide 201. Likewise, coupling surface 207 allows bottom guide electromagnetic wave 204, moving radially from the center feed point 205, to couple into top guide 201 thus compensating the power density of the electromagnetic wave so that it is no longer inversely proportional to the radius of the guide.

Figure 2C:
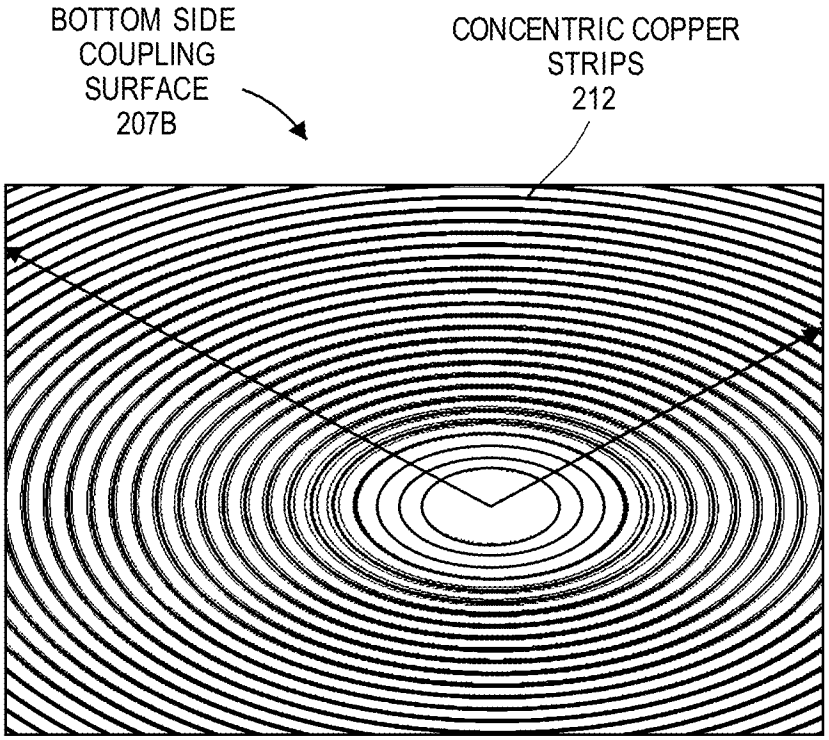
FIGS. 2B-2C illustrate examples of top and bottom views of the coupling surface or directional coupler of the center fed antenna of FIG. 2A.
Figure 2B:
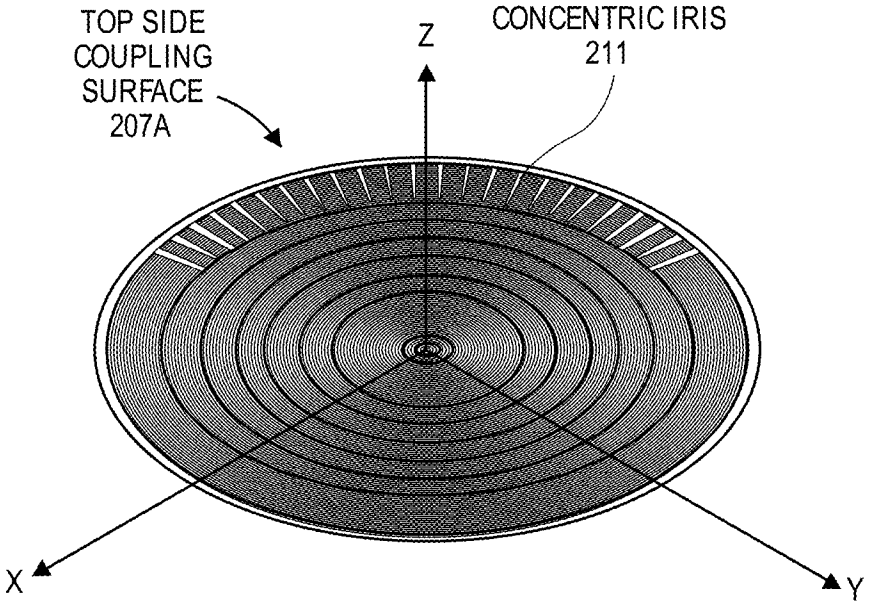

FIGS. 2B-2C illustrate examples of top and bottom views 207A and 207B of the coupling surface 207 or directional coupler of center fed antenna 200 of FIG. 2A. Top side coupling surface 207A shows concentric irises 211 and bottom side coupling surface 207B shows concentric copper strips 212. Referring to FIG. 2B, in one example, concentric irises 211 can be etched into a metal and can be 5 mm wide and spaced apart from each other. In one example, irises 211 can have a gap, or spacing, between each other on one side of the coupling surface 207 and at least a portion of a metal strip (e.g., copper) 212 is positioned on the other side of coupling surface 207 beneath at least a portion of that gap.

Referring to FIG. 2C, in one example, concentric metal strips, e.g., copper strips 212 (or rings) can have varying widths. In one example, the copper strips 212 can become wider than copper strips closer to center feed point 205. In another example, the width of copper strips 112 can be the same for each of the copper strips. In another embodiment, the copper strips 212 are made of another material, such as, for example, aluminum. In one example, the copper strips 212 or rings are spaced apart so that the reflections add up and cancel each other out. In one example, for one frequency of operation, spacing the rings with a $\lambda/4$ spacing results in this canceling effect. Although circular strips or rings are used, other geometries can be used such as, for example, overlapping squares or circular irises. In one example, a layer can be placed in between top side coupling surface 207A and bottom side coupling surface 207B which can be, for example, a polyimide film or board such as a Kapton board.

Figure 2D:
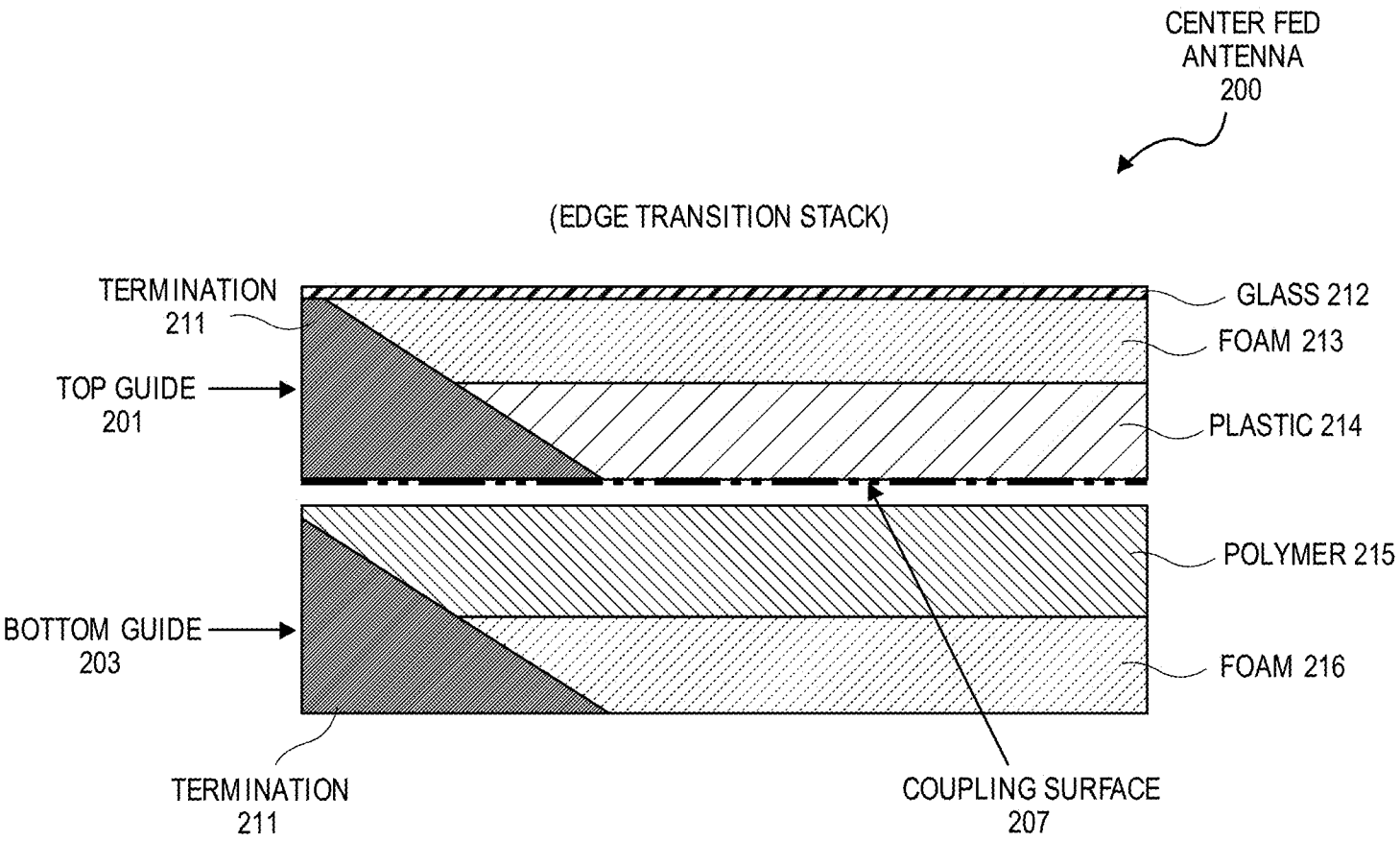
FIG. 2D illustrates one example of a cross-sectional view from the perspective of the edge transition stack of a center fed antenna.
Figure 2E:
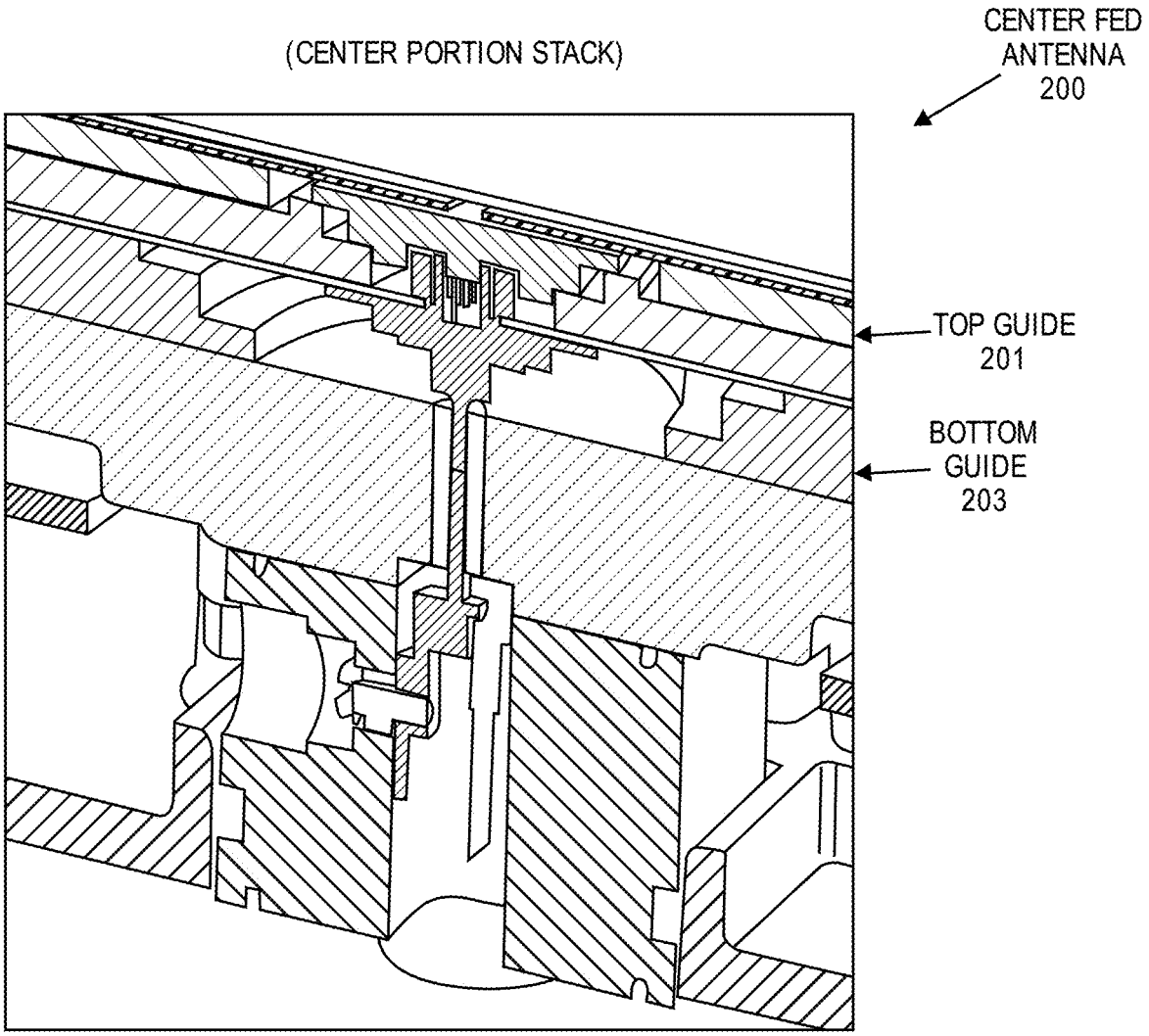
FIG. 2E shows a three-dimensional view of a center fed antenna of FIG. 2A from the perspective of the center stack.

FIG. 2D illustrates one example of a cross-sectional view from the perspective of the edge transition stack of center fed antenna 200 showing varying layers in the chambers for the top guide 201 and bottom guide 203. Referring to FIG. 2D, at one of the edges of center fed antenna, each of the top guide 201 and bottom guide 203 includes terminations 211. Terminations 211 can be rigid, flexible or castable terminations such as Eccosorb terminations. Coupling surface 207 is positioned in between and separates top guide 201 and bottom guide 203. In one example, coupling surface 207 can be 2 mm thick with double sided copper on a multi-layer circuit board substrate such as Megtron 6, which can act as a ground plane. Top guide 201 includes a glass layer 212, foam layer 213, and a plastic layer 214. In one example, glass layer 212 can be fused silica glass and plastic 214 can be Rexolite. Bottom guide 203 can include a polymer layer 215 such as polyethylene and a foam layer 216. FIG. 2E shows a three-dimensional view of top guide 201 and bottom guide 203 of center fed antenna 200 from the perspective of the center stack.

Directional Coupler Design

Figure 3A:
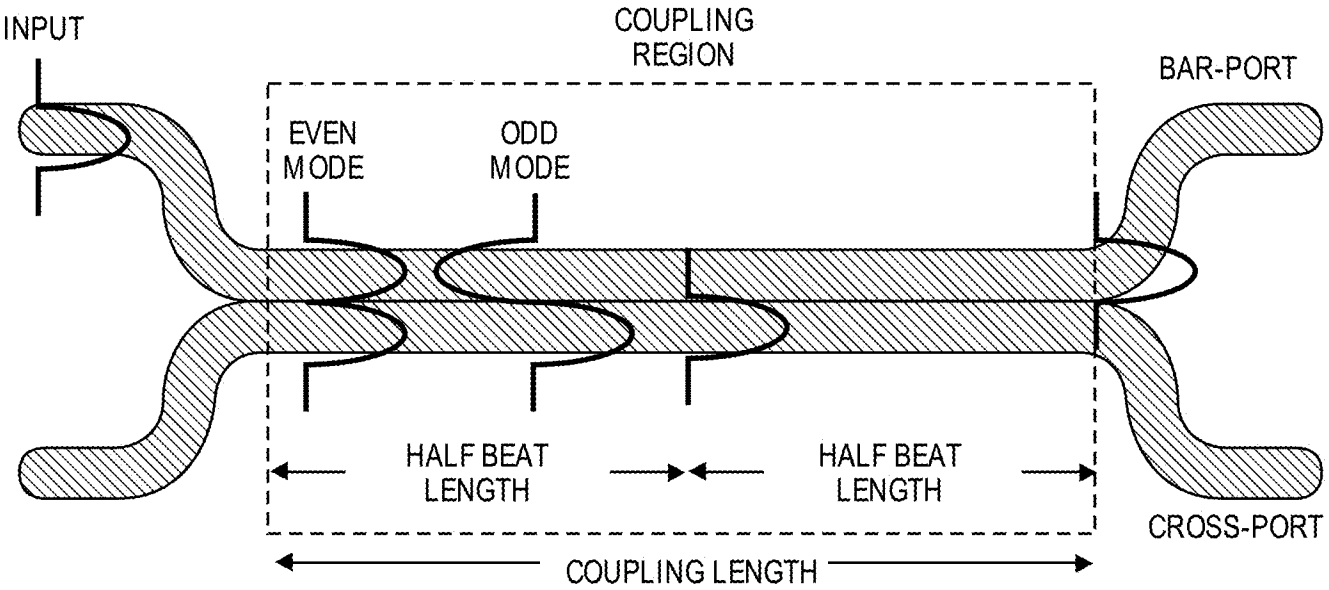
FIG. 3A illustrates an exemplary diagram relating to coupled mode theory of two elements.
Figure 3B:
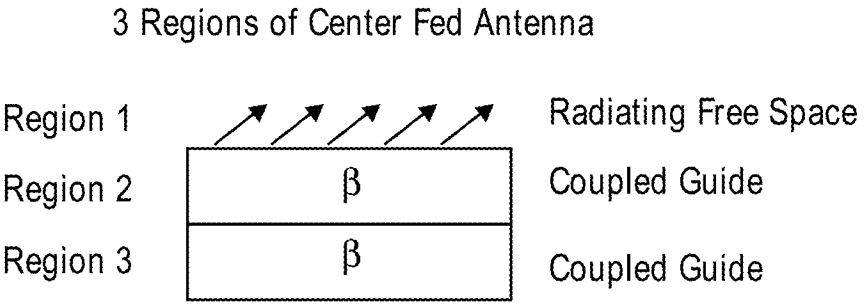
FIG. 3B illustrates an exemplary diagram showing the region relationship of a directional coupler fed antenna for coupled mode theory differential equations.
Figure 3C:
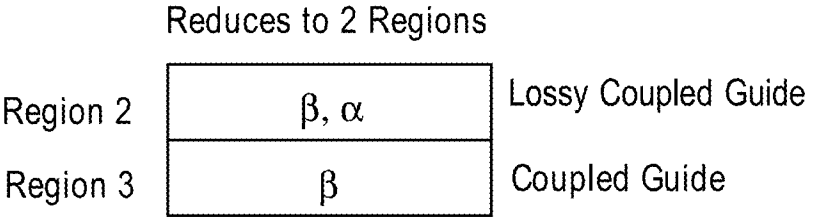
FIG. 3C illustrates an exemplary diagram showing the region relationship reducing to two regions for the coupled mode theory differential equations.

Exemplary coupling surfaces or directional coupler as described in FIGS. 2A-2D and 4A-4B can be configured, designed and modeled using ordinary differential equations (ODE) related to coupled mode theory for the antenna systems as described in FIGS. 3A-3C. Based on the ODE equations, the discloses examples and embodiments of the coupling surface for antenna systems can be configured to a desired coupling rate or optimized coupling curves in order to provide for a more uniform aperture distribution for the antenna systems. In one example, the coupling surface can be designed or configured to control coupling of the guided feed wave to the antenna elements, which includes control of vertical coupling or lateral coupling of the guided feed wave in the guided wave transmission line or waveguides to the antenna elements. The coupling surface can also be configured to spatially filter the guided feed wave to provide a more uniform power density for the antenna elements.

FIG. 3A illustrates a diagram relating to coupled mode theory of waveguides and related examples of ODE for improved aperture distribution which are provided below:

Ordinary Differential Equations (ODEs)

The equations for the field amplitudes $u_m(z)=a_m+(z)e^{-j\beta_m z}$ are $$\frac{d}{dz}u_0 = -j\beta_0 u_0 - j_{\kappa u_1} \quad \text{where } \kappa = \kappa_{1,2} = \kappa_{2,1}$$
$$\frac{d}{dz}u_1 = -j\beta_1 u_0 - j_{\kappa u_0}$$

which have simple solutions:

$$I_0(z) = |u_0(z)|^2 = \frac{\cos^2(gz) + \gamma^2}{1 + \gamma^2}$$

$$I_1(z) = |u_1(z)|^2 = \frac{\sin^2(gz)}{1 + \gamma^2}$$

where $$g^2 \equiv \kappa^2 + \left(\frac{\beta_0 - \beta_1}{2}\right)^2$$

$$\gamma \equiv \frac{\left(\frac{\beta_0 - \beta_1}{\kappa}\right)/2}{\kappa}$$

The above ODEs provide a theoretical basis in coupled mode theory for the improved distribution. This coupled mode theory relates to optical co-directional couplers. In one example, the directional coupler disclosed herein involves solving a system of differential equations as disclosed in A. Yariv, "Coupled-Mode Theory for Guided-Wave Optics," IEEE Journal of Quantum Electronics, vol. QE-9, No. 9, September 1973 and Robert R McLeod, University of Colorado, ECE 4006/5166 Guided Wave Optics, chapter on Coupled Modes—Derivation.

In one example, designing the directional coupler disclosed herein involves reformulating the ordinary differential equations (ODEs) and solving them for a different answer due to the presence of radiation in one of the waveguides in the center fed antenna. The resulting solution is different than for the optical directional couplers and is unique to this invention. The directional coupler as designed herein can be useful for both cylindrical leaky wave antennas as well as linear antennas. The desired aperture distribution is a result of the solution of the system of equations and can be a uniform or tapered distribution.

Regarding the system of the center fed antenna as disclosed in FIGS. 2A-2E and 4A-4B, the systems can be divided up in three regions (Regions 1-3) as shown in in FIG. 3B. Region 1 relating to radiating free space in the system. Regions 2 and 3 relating to the waveguides, e.g., top and bottom guides of leaky wave antennas, e.g., antenna 200. For this system relating to Regions 1-3 of the center fed antenna, the ODE describing the region relationships is provided below:

Exemplary Antenna System ODEs to Describe Region Relationship $dE_1/dx-\alpha E_2=0$ $dE_2/dx+jkE_3+\alpha E_2 0$ $dE_3/dx+jkE_2=0$ α is radiation rate
k is coupling rate
Boundary Conditions
$E_2(0)=0$
$E_3(0)=1$ The ODE equations for the antenna system can be reduced to two regions as shown in FIG. 3C (Regions 2 and 3) where Region 2 refers to a lossy coupled guide and Region 3 refers to a coupled guide or waveguide. The ODE equations can reduce to a 2-equation system of the center fed antenna as reproduced below:

Reduced to Two Equation System ODE $dE_2/dx+jkE_e+\alpha E_2=0$ $dE_3/dx+jkE_2=0$ α is radiation rate
k is coupling rate
Boundary Conditions
$E_2(0)=0$
$E_3(0)=1$ The equations yield solutions for E3 and E2 and inputs include coupling and radiation rates. In one example, designing the coupling surface (directional coupler) assumes a constant radiation rate, and a variable coupling rate. The aperture distribution can then be calculated from the solution of the ODEs, as described below:

Solutions Yield $E_3$ and $E_2$ $P_{top\ guide}=E_2E_2^*/ZP_{bottom\ guide}=E_3E_3^*/Z$ $P_{radiated}=1-P_{top\ guide}-P_{bottom\ guide}$ $|A(z)|^2=d/dzP_{radiated}$ The coupling surface can be designed to achieve a desired coupling rate or optimizing coupling curves for the system using the above ODEs in order to provide for a more uniform aperture distribution $|A(z)|^2$. Such a directional coupler can provide for more uniform and improved illumination control of wave propagating along the aperture of the antenna.

By using such a directional coupler to improve aperture distribution, the system can provide a number of improvements. Examples of improvements can include aperture efficiency improvement and improved feed loss providing higher antenna gain aperture size can increase without drastically reducing aperture efficiency. Other advantages of using the directional coupler include simple mechanical implementation and lower building costs. Optimizing the directional coupler to provide different aperture distributions that are not uniform, but still desirable is possible. For example, targeting a Taylor or Chebychev distribution is possible for lowered radiation pattern sidelobes.

Other Antenna Systems with Directional Couplers

Figure 4A:
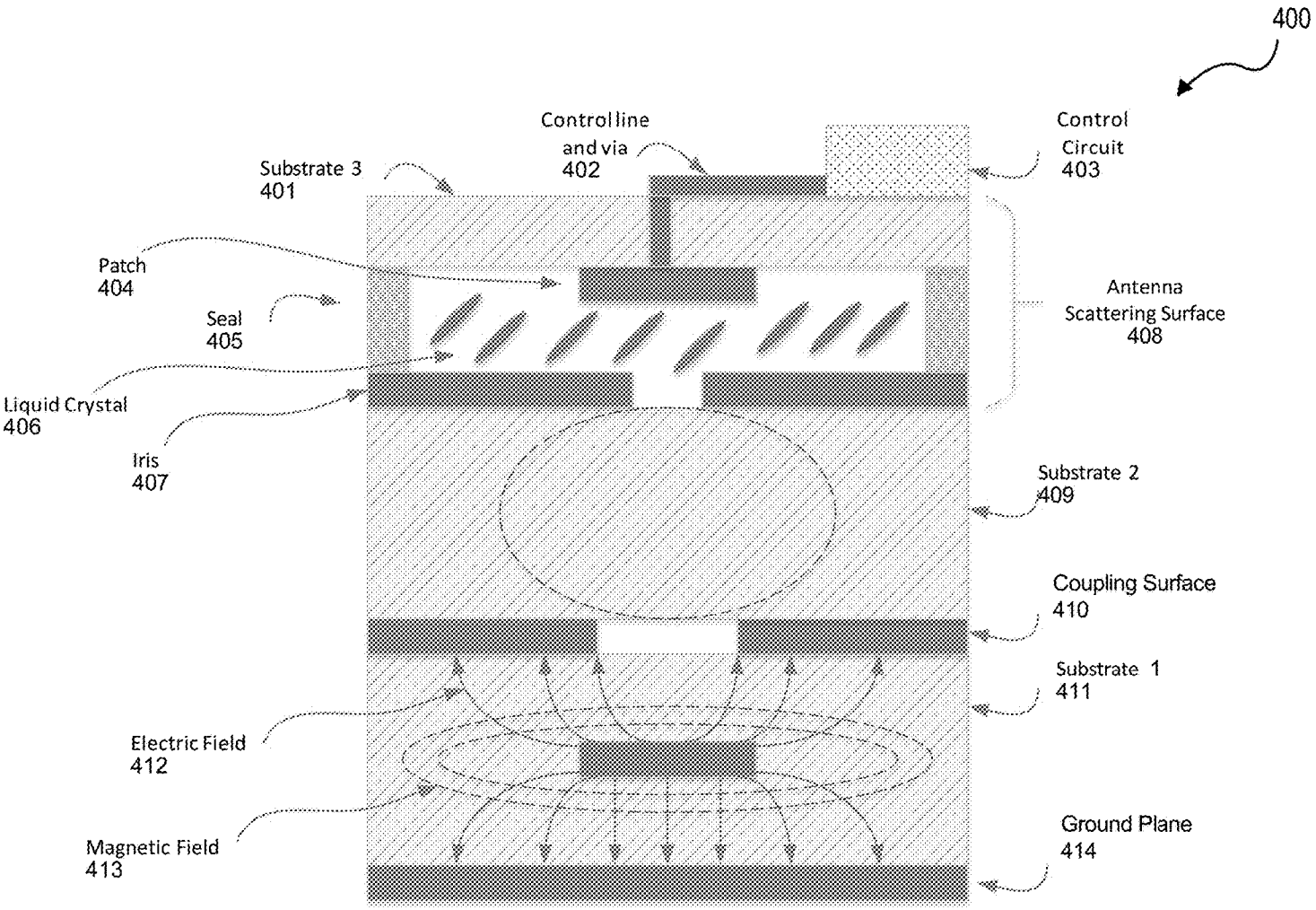
FIG. 4A illustrates one example of a cross-section view of an antenna having a directional coupler for controlling vertical coupling in a multi-layer printed circuit board (PCB) stripline system.

FIG. 4A illustrates one example of a cross-section view of an antenna 400 having a directional coupler for controlling vertical coupling in multi-layer printed circuit board (PCB) stripline system. Antenna 400 includes a first substrate 411 attached to a ground plane 414 which can act as guided wave transmission line to provide a guided wave having an electric field 412 and a magnetic 413. A coupling surface 410 can be a strip or layer formed on top of the first substrate 411 which can act as a ground plane and separate the first substrate 411 from a second substrate 409 formed on coupling surface 410. On top of the second substrate 409, antenna scattering surface 408 is formed which includes iris 407, liquid crystal 406, seal 405, patch 404, and a third substrate 401, and control line and via 402 coupled to control circuit 403 to control activation of the liquid crystal 406. Active scattering surface 408 and related components can operate in a manner described in FIGS. 5A-23B. In one example, according directional coupler design techniques described in FIGS. 3A-3C, coupling surface 410 can be configured to couple a guided feed wave or electromagnetic wave in the first substrate 411 to increase power density along the length of the second substrate 409 for antenna elements of antenna scattering surface 403. As such, coupling surface 410 can allow the electromagnetic wave in the first substrate 411, moving radially, to couple into the second substrate 409 thereby compensating the power density of the electromagnetic wave in the second substrate 409.

Figure 4B:
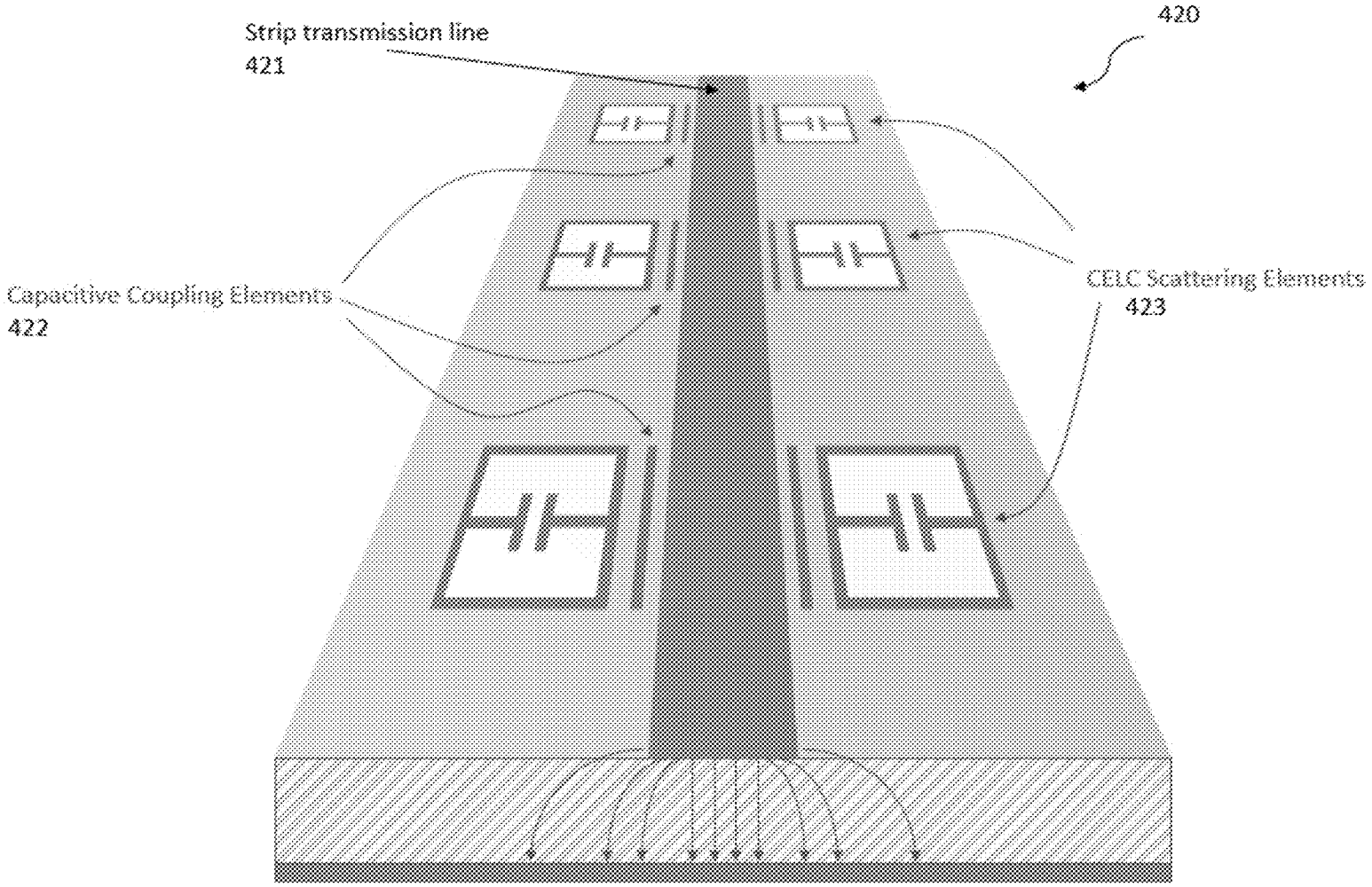
FIG. 4B illustrates one example of a top view of an antenna having a directional coupler for controlling lateral coupling with a microstrip line system.

FIG. 4B illustrates one example of a top view of an antenna 420 having a directional coupler for controlling lateral coupling with a microstrip line system embodiment. Antenna 420 includes a microstrip transmission line 421 which can provide a guided feed wave. Capacitive coupling elements 422 can act as a directional coupler and separate the strip transmission line 421 from antenna elements or complementary electric inductive-capacitive resonator ("complementary electric LC" or "CELC") scattering elements 423 which can be etched in or deposited onto an upper conductor of the antenna 420. LC in the context of CELC refers to inductance-capacitance, as opposed to liquid crystal. In the example of FIG. 4B, capacitive coupling elements 422 can be configured and implemented according to techniques described in FIGS. 3A-3C to control lateral coupling of a guided feed wave or electromagnetic wave in strip transmission line 421 with CELC scattering elements 423.

Exemplary Flat Panel Antennas

The above directional coupler feed examples and embodiments as described in FIGS. 1-4B can be implemented in for flat panel antennas as described in FIGS. 5A-23B. In one example, the flat panel antenna is part of a metamaterial antenna system. Examples of a metamaterial antenna system for communications satellite earth stations are described. In one example, the antenna system is a component or subsystem of a satellite earth station (ES) operating on a mobile platform (e.g., aeronautical, maritime, land, etc.) that operates using frequencies for civil commercial satellite communications. In some examples, the antenna system also can be used in earth stations that are not on mobile platforms (e.g., fixed or transportable earth stations).

In one example, the antenna system uses surface scattering metamaterial technology to form and steer transmit and receive beams through separate antennas. In one example, the antenna systems are analog systems, in contrast to antenna systems that employ digital signal processing to electrically form and steer beams (such as phased array antennas).

In one example, the antenna system is comprised of three functional subsystems: (1) a wave guiding structure consisting of a cylindrical wave feed architecture; (2) an array of wave scattering metamaterial unit cells that are part of antenna elements; and (3) a control structure to command formation of an adjustable radiation field (beam) from the metamaterial scattering elements using holographic principles.

Example Wave Guide Structures for Flat Panel Antennas

Figure 5A:
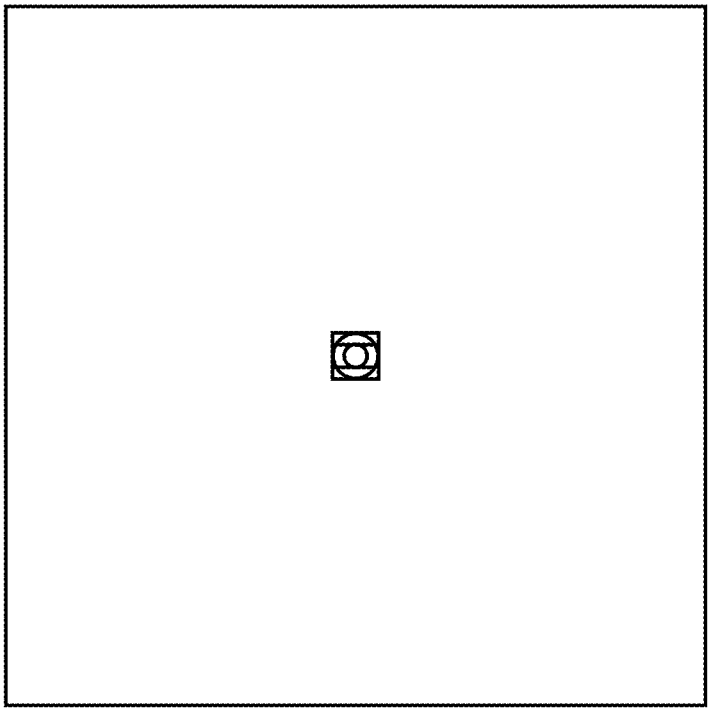
FIG. 5A illustrates a top view of one example of a coaxial feed that is used to provide a cylindrical wave feed.
Figure 5B:
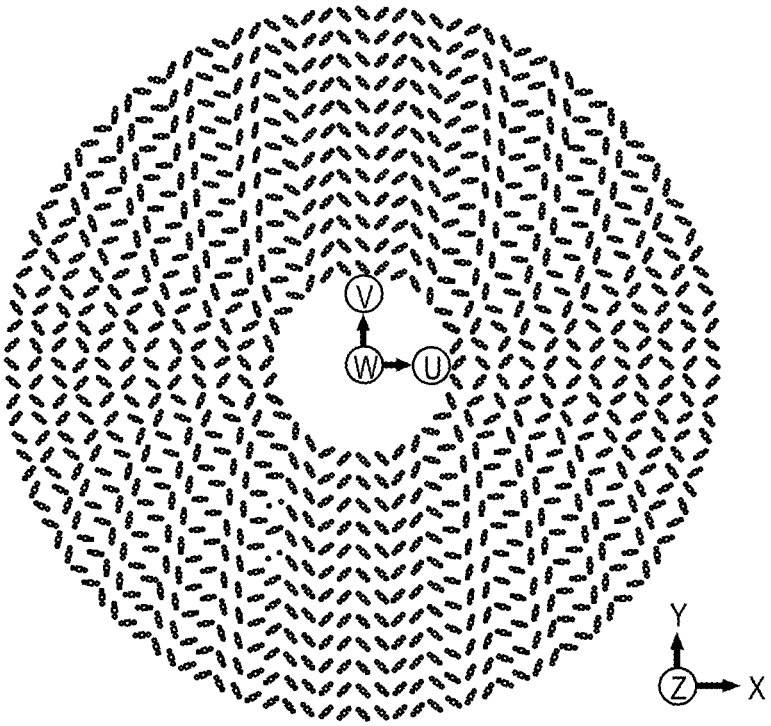
FIG. 5B illustrates an aperture having one or more arrays of antenna elements placed in concentric rings around an input feed of the cylindrically fed antenna according to one example.

FIG. 5A illustrates a top view of one example of a coaxial feed that is used to provide a cylindrical wave feed. Referring to FIG. 5A, the coaxial feed includes a center conductor and an outer conductor. In one example, the cylindrical wave feed architecture feeds the antenna from a central point with an excitation that spreads outward in a cylindrical manner from the feed point. That is, a cylindrically fed antenna creates an outward travelling concentric feed wave. In one example, the shape of the cylindrical feed antenna around the cylindrical feed can be circular, square or any shape. In another example, a cylindrically fed antenna creates an inward travelling feed wave. In such a case, the feed wave most naturally comes from a circular structure. FIG. 5B illustrates an aperture having one or more arrays of antenna elements placed in concentric rings around an input feed of the cylindrically fed antenna.

Antenna Elements

In one example, the antenna elements comprise a group of patch and slot antennas (unit cells). This group of unit cells comprises an array of scattering metamaterial elements. In one example, each scattering element in the antenna system is part of a unit cell that consists of a lower conductor, a dielectric substrate and an upper conductor that embeds a complementary electric inductive-capacitive resonator ("complementary electric LC" or "CELC") that is etched in or deposited onto the upper conductor. LC in the context of CELC refers to inductance-capacitance, as opposed to liquid crystal.

In one example, a liquid crystal (LC) is disposed in the gap around the scattering element. Liquid crystal is encapsulated in each unit cell and separates the lower conductor associated with a slot from an upper conductor associated with its patch. Liquid crystal has a permittivity that is a function of the orientation of the molecules comprising the liquid crystal, and the orientation of the molecules (and thus the permittivity) can be controlled by adjusting the bias voltage across the liquid crystal. Using this property, in one example, the liquid crystal integrates an on/off switch and intermediate states between on and off for the transmission of energy from the guided wave to the CELC. When switched on, the CELC emits an electromagnetic wave like an electrically small dipole antenna. The teachings and techniques described herein are not limited to having a liquid crystal that operates in a binary fashion with respect to energy transmission.

In one example, the feed geometry of this antenna system allows the antenna elements to be positioned at forty-five degree (45°) angles to the vector of the wave in the wave feed. Note that other positions may be used (e.g., at 40° angles). This position of the elements enables control of the free space wave received by or transmitted/radiated from the elements. In one example, the antenna elements are arranged with an inter-element spacing that is less than a free-space wavelength of the operating frequency of the antenna. For example, if there are four scattering elements per wavelength, the elements in the 30 GHz transmit antenna will be approximately 2.5 mm (i.e., ¼th the 10 mm free-space wavelength of 30 GHz).

In one example, the two sets of elements are perpendicular to each other and simultaneously have equal amplitude excitation if controlled to the same tuning state. Rotating them +/−45 degrees relative to the feed wave excitation achieves both desired features at once. Rotating one set 0 degrees and the other 90 degrees would achieve the perpendicular goal, but not the equal amplitude excitation goal. Note that 0 and 90 degrees may be used to achieve isolation when feeding the array of antenna elements in a single structure from two sides as described above.

The amount of radiated power from each unit cell is controlled by applying a voltage to the patch (potential across the LC channel) using a controller. Traces to each patch are used to provide the voltage to the patch antenna. The voltage is used to tune or detune the capacitance and thus the resonance frequency of individual elements to effectuate beam forming. The voltage required is dependent on the liquid crystal mixture being used. The voltage tuning characteristic of liquid crystal mixtures is mainly described by a threshold voltage at which the liquid crystal starts to be affected by the voltage and the saturation voltage, above which an increase of the voltage does not cause major tuning in liquid crystal. These two characteristic parameters can change for different liquid crystal mixtures.

In one example, a matrix drive is used to apply voltage to the patches in order to drive each cell separately from all the other cells without having a separate connection for each cell (direct drive). Because of the high density of elements, the matrix drive is the most efficient way to address each cell individually.

In one example, the control structure for the antenna system has 2 main components: the controller, which includes drive electronics for the antenna system, is below the wave scattering structure, while the matrix drive switching array is interspersed throughout the radiating RF array in such a way as to not interfere with the radiation. In one example, the drive electronics for the antenna system comprise commercial off-the-shelf LCD controls used in commercial television appliances that adjust the bias voltage for each scattering element by adjusting the amplitude of an AC bias signal to that element.

In one example, the controller also contains a microprocessor executing software. The control structure may also incorporate sensors (e.g., a GPS receiver, a three-axis compass, a 3-axis accelerometer, 3-axis gyro, 3-axis magnetometer, etc.) to provide location and orientation information to the processor. The location and orientation information may be provided to the processor by other systems in the earth station and/or may not be part of the antenna system.

More specifically, the controller controls which elements are turned off and which elements are turned on and at which phase and amplitude level at the frequency of operation. The elements are selectively detuned for frequency operation by voltage application.

For transmission, a controller supplies an array of voltage signals to the RF patches to create a modulation, or control pattern. The control pattern causes the elements to be turned to different states. In one example, multistate control is used in which various elements are turned on and off to varying levels, further approximating a sinusoidal control pattern, as opposed to a square wave (i.e., a sinusoid gray shade modulation pattern). In one example, some elements radiate more strongly than others, rather than some elements radiate and some do not. Variable radiation is achieved by applying specific voltage levels, which adjusts the liquid crystal permittivity to varying amounts, thereby detuning elements variably and causing some elements to radiate more than others.

The generation of a focused beam by the metamaterial array of elements can be explained by the phenomenon of constructive and destructive interference. Individual electromagnetic waves sum up (constructive interference) if they have the same phase when they meet in free space and waves cancel each other (destructive interference) if they are in opposite phase when they meet in free space. If the slots in a slotted antenna are positioned so that each successive slot is positioned at a different distance from the excitation point of the guided wave, the scattered wave from that element will have a different phase than the scattered wave of the previous slot. If the slots are spaced one quarter of a guided wavelength apart, each slot will scatter a wave with a one fourth phase delay from the previous slot.

Using the array, the number of patterns of constructive and destructive interference that can be produced can be increased so that beams can be pointed theoretically in any direction plus or minus ninety degrees (90°) from the bore sight of the antenna array, using the principles of holography. Thus, by controlling which metamaterial unit cells are turned on or off (i.e., by changing the pattern of which cells are turned on and which cells are turned off), a different pattern of constructive and destructive interference can be produced, and the antenna can change the direction of the main beam. The time required to turn the unit cells on and off dictates the speed at which the beam can be switched from one location to another location.

In one example, the antenna system produces one steerable beam for the uplink antenna and one steerable beam for the downlink antenna. In one example, the antenna system uses metamaterial technology to receive beams and to decode signals from the satellite and to form transmit beams that are directed toward the satellite. In one example, the antenna systems are analog systems, in contrast to antenna systems that employ digital signal processing to electrically form and steer beams (such as phased array antennas). In one example, the antenna system is considered a "surface" antenna that is planar and relatively low profile, especially when compared to conventional satellite dish receivers.

Figure 6:
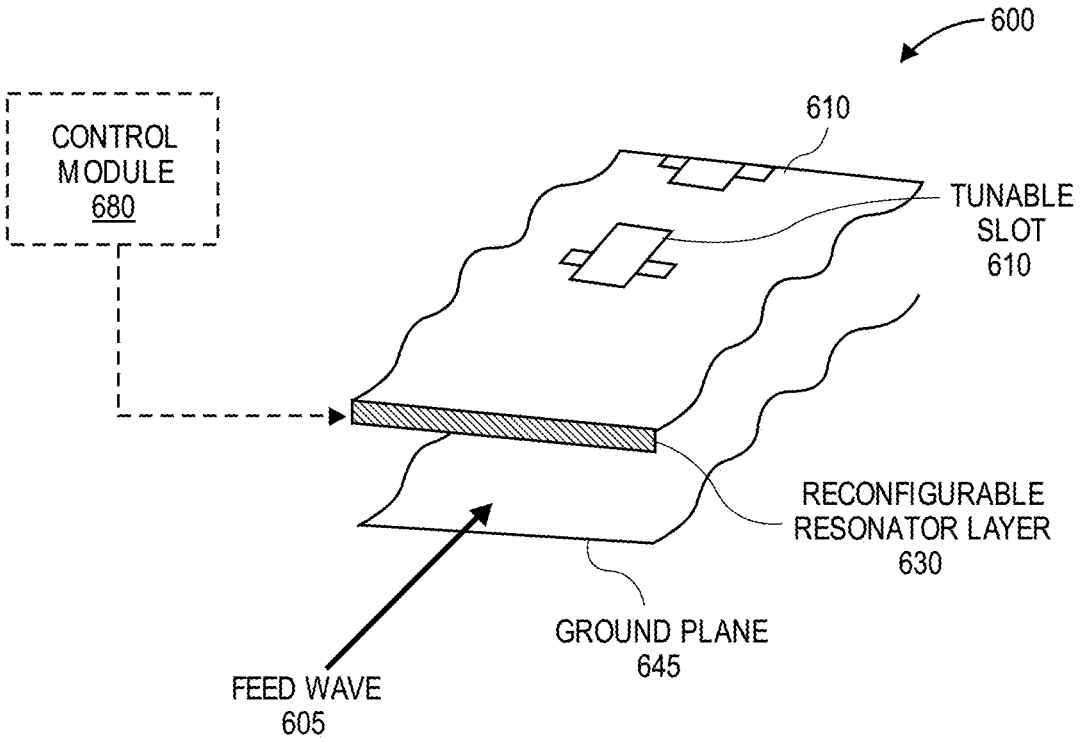
FIG. 6 illustrates a perspective view of one row of antenna elements that includes a ground plane and a reconfigurable resonator layer according to one example.

FIG. 6 illustrates a perspective view 600 of one row of antenna elements that includes a ground plane 645 and a reconfigurable resonator layer 630. Reconfigurable resonator layer 630 includes an array of tunable slots 610. The array of tunable slots 610 can be configured to point the antenna in a desired direction. Each of the tunable slots can be tuned/adjusted by varying a voltage across the liquid crystal.

Control module 680 is coupled to reconfigurable resonator layer 630 to modulate the array of tunable slots 610 by varying the voltage across the liquid crystal in FIG. 6. Control module 680 may include a Field Programmable Gate Array ("FPGA"), a microprocessor, a controller, System-on-a-Chip (Sock), or other processing logic. In one example, control module 680 includes logic circuitry (e.g., multiplexer) to drive the array of tunable slots 610. In one example, control module 680 receives data that includes specifications for a holographic diffraction pattern to be driven onto the array of tunable slots 610. The holographic diffraction patterns may be generated in response to a spatial relationship between the antenna and a satellite so that the holographic diffraction pattern steers the downlink beams (and uplink beam if the antenna system performs transmit) in the appropriate direction for communication. Although not drawn in each figure, a control module similar to control module 680 may drive each array of tunable slots described in the figures of the disclosure.

Radio Frequency ("RF") holography is also possible using analogous techniques where a desired RF beam can be generated when an RF reference beam encounters an RF holographic diffraction pattern. In the case of satellite communications, the reference beam is in the form of a feed wave, such as feed wave 605 (approximately 20 GHz in some examples). To transform a feed wave into a radiated beam (either for transmitting or receiving purposes), an interference pattern is calculated between the desired RF beam (the object beam) and the feed wave (the reference beam). The interference pattern is driven onto the array of tunable slots 610 as a diffraction pattern so that the feed wave is "steered" into the desired RF beam (having the desired shape and direction). In other words, the feed wave encountering the holographic diffraction pattern "reconstructs" the object beam, which is formed according to design requirements of the communication system. The holographic diffraction pattern contains the excitation of each element and is calculated by $w_{hologram}=w^*_{in}w_{out}$, with $w_{in}$ as the wave equation in the waveguide and $w_{out}$ the wave equation on the outgoing wave.

Figure 7:
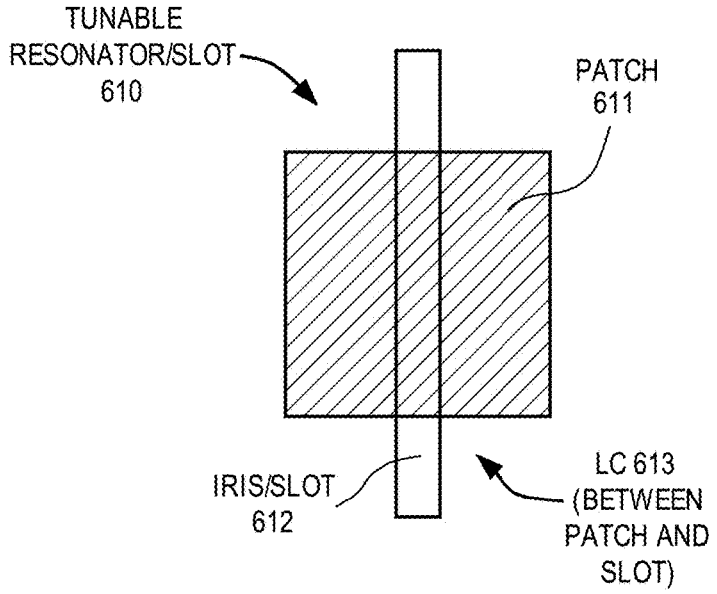
FIG. 7 illustrates one example of a tunable resonator/slot.

FIG. 7 illustrates one example of a tunable resonator/slot 610. Tunable slot 610 includes an iris/slot 612, a radiating patch 611, and liquid crystal (LC) 613 disposed between iris 612 and patch 611. In one example, radiating patch 611 is co-located with iris 612.

Figure 8:
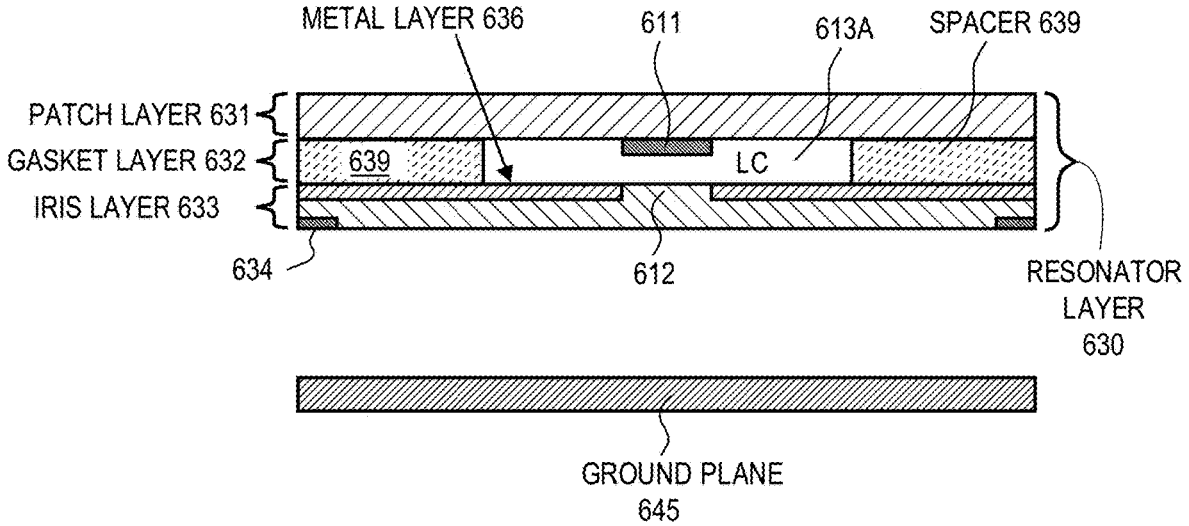
FIG. 8 illustrates a cross section view of one example of a physical antenna aperture.

FIG. 8 illustrates a cross section view of a physical antenna aperture according to one example. The antenna aperture includes ground plane 645, and a metal layer 636 within iris layer 633, which is included in reconfigurable resonator layer 630. In one example, the antenna aperture of FIG. 8 includes a plurality of tunable resonator/slots 610 of FIG. 7. Iris/slot 612 is defined by openings in metal layer 636. A feed wave, such as feed wave 605 of FIG. 6, may have a microwave frequency compatible with satellite communication channels. The feed wave propagates between ground plane 645 and resonator layer 630.

Reconfigurable resonator layer 630 also includes gasket layer 632 and patch layer 631. Gasket layer 632 is disposed between patch layer 631 and iris layer 633. In one example, a spacer could replace gasket layer 632. In one example, Iris layer 633 is a printed circuit board ("PCB") that includes a copper layer as metal layer 636. In one example, iris layer 633 is glass. Iris layer 633 may be other types of substrates.

Openings may be etched in the copper layer to form slots 612. In one example, iris layer 633 is conductively coupled by a conductive bonding layer to another structure (e.g., a waveguide) in FIG. 8. Note that in an example the iris layer is not conductively coupled by a conductive bonding layer and is instead interfaced with a non-conducting bonding layer.

Patch layer 631 may also be a PCB that includes metal as radiating patches 611. In one example, gasket layer 632 includes spacers 639 that provide a mechanical standoff to define the dimension between metal layer 636 and patch 611. In one example, the spacers are 75 microns, but other sizes may be used (e.g., 3-200 mm). As mentioned above, in one example, the antenna aperture of FIG. 8 includes multiple tunable resonator/slots, such as tunable resonator/slot 610 includes patch 611, liquid crystal 613, and iris 612 of FIG. 7. The chamber for liquid crystal 613 is defined by spacers 639, iris layer 633 and metal layer 636. When the chamber is filled with liquid crystal, patch layer 631 can be laminated onto spacers 639 to seal liquid crystal within resonator layer 630.

A voltage between patch layer 631 and iris layer 633 can be modulated to tune the liquid crystal in the gap between the patch and the slots (e.g., tunable resonator/slot 610). Adjusting the voltage across liquid crystal 613 varies the capacitance of a slot (e.g., tunable resonator/slot 610). Accordingly, the reactance of a slot (e.g., tunable resonator/slot 610) can be varied by changing the capacitance. Resonant frequency of slot 610 also changes according to the equation $$f = \frac{1}{2\pi\sqrt{LC}}$$

where f is the resonant frequency of slot 610 and L and C are the inductance and capacitance of slot 610, respectively. The resonant frequency of slot 610 affects the energy radiated from feed wave 605 propagating through the waveguide. As an example, if feed wave 605 is 20 GHz, the resonant frequency of a slot 610 may be adjusted (by varying the capacitance) to 17 GHz so that the slot 610 couples substantially no energy from feed wave 605. Or, the resonant frequency of a slot 610 may be adjusted to 20 GHz so that the slot 610 couples energy from feed wave 605 and radiates that energy into free space. Although the examples given are binary (fully radiating or not radiating at all), full grey scale control of the reactance, and therefore the resonant frequency of slot 610 is possible with voltage variance over a multi-valued range. Hence, the energy radiated from each slot 610 can be finely controlled so that detailed holographic diffraction patterns can be formed by the array of tunable slots.

In one example, tunable slots in a row are spaced from each other by λ/5. Other types of spacing may be used. In one example, each tunable slot in a row is spaced from the closest tunable slot in an adjacent row by λ/2, and, thus, commonly oriented tunable slots in different rows are spaced by λ/4, though other spacing are possible (e.g., λ/5, λ/6.3). In another example, each tunable slot in a row is spaced from the closest tunable slot in an adjacent row by λ/3.

Examples of the invention use reconfigurable metamaterial technology, such as described in U.S. patent application Ser. No. 14/550,178, entitled "Dynamic Polarization and Coupling Control from a Steerable Cylindrically Fed Holographic Antenna", filed Nov. 21, 2014 and U.S. patent application Ser. No. 14/610,502, entitled "Ridged Waveguide Feed Structures for Reconfigurable Antenna", filed Jan. 30, 2015, to the multi-aperture needs of the marketplace.

Figure 9A:
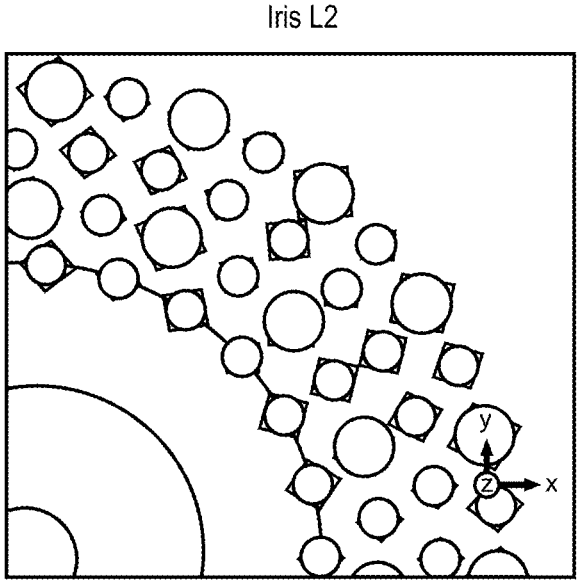
FIGS. 9A-9D illustrate one example of the different layers for creating the slotted array.
Figure 9B:
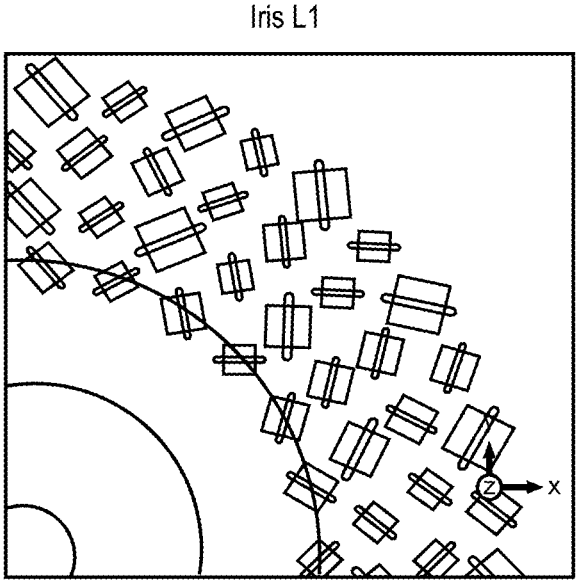
Figure 9C:
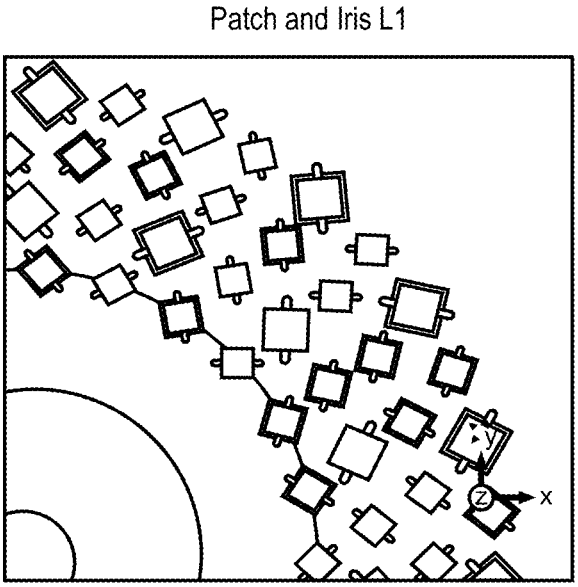
Figure 9D:
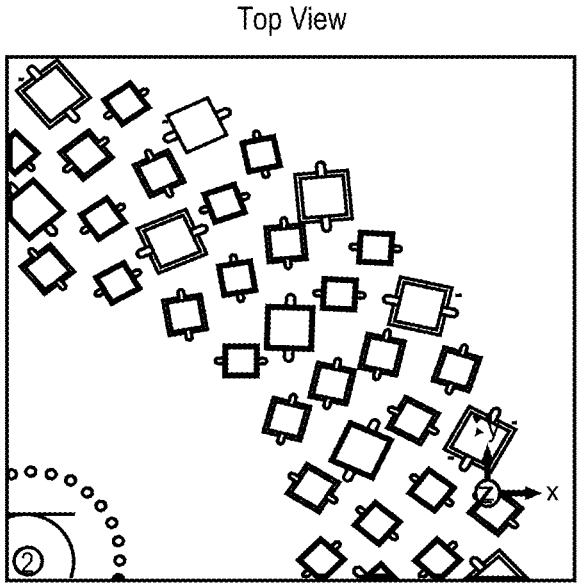

FIG. 9A-9D illustrate one example of the different layers for creating the slotted array. Note that in this example the antenna array has two different types of antenna elements that are used for two different types of frequency bands. FIG. 9A illustrates a portion of the first iris board layer with locations corresponding to the slots according to one example. Referring to FIG. 9A, the circles are open areas/slots in the metallization in the bottom side of the iris substrate, and are for controlling the coupling of elements to the feed (the feed wave). In this example, this layer is an optional layer and is not used in all designs. FIG. 9B illustrates a portion of the second iris board layer containing slots according to one example. FIG. 9C illustrates patches over a portion of the second iris board layer according to one example. FIG. 9D illustrates a top view of a portion of the slotted array according to one example.

FIG. 10A illustrates a side view of one example of a cylindrically fed antenna structure. The antenna produces an inwardly travelling wave using a double layer feed structure (i.e., two layers of a feed structure). In one example, the antenna includes a circular outer shape, though this is not required. That is, non-circular inward travelling structures can be used. In one example, the antenna structure in FIG. 10A includes the coaxial feed of FIGS. 5A-5B.

Referring to FIG. 10A, a coaxial pin 1001 is used to excite the field on the lower level of the antenna. In one example, coaxial pin 1001 is a 50Ω coax pin that is readily available. Coaxial pin 1001 is coupled (e.g., bolted) to the bottom of the antenna structure, which is conducting ground plane 1002.

Separate from conducting ground plane 1002 is interstitial conductor 1003, which is an internal conductor. In one example, conducting ground plane 1002 and interstitial conductor 1003 are parallel to each other. In one example, the distance between ground plane 1002 and interstitial conductor 1003 is 0.1-0.15". In another example, this distance may be $\lambda/2$, where $\lambda$ is the wavelength of the travelling wave at the frequency of operation.

Ground plane 1002 is separated from interstitial conductor 1003 via a spacer 1004. In one example, spacer 1004 is a foam or air-like spacer. In one example, spacer 1004 comprises a plastic spacer.

On top of interstitial conductor 1003 is dielectric layer 1005. In one example, dielectric layer 1005 is plastic. The purpose of dielectric layer 1005 is to slow the travelling wave relative to free space velocity. In one example, dielectric layer 1005 slows the travelling wave by 30% relative to free space. In one example, the range of indices of refraction that are suitable for beam forming are 1.2-1.8, where free space has by definition an index of refraction equal to 1. Other dielectric spacer materials, such as, for example, plastic, may be used to achieve this effect. Note that materials other than plastic may be used as long as they achieve the desired wave slowing effect. Alternatively, a material with distributed structures may be used as dielectric 1005, such as periodic sub-wavelength metallic structures that can be machined or lithographically defined, for example.

An RF-array 1006 is on top of dielectric 1005. In one example, the distance between interstitial conductor 1003 and RF-array 1006 is 0.1-0.15". In another example, this distance may be $\lambda_{eff}/2$, where $\lambda_{eff}$ is the effective wavelength in the medium at the design frequency.

The antenna includes sides 1007 and 1008. Sides 1007 and 1008 are angled to cause a travelling wave feed from coax pin 1001 to be propagated from the area below interstitial conductor 1003 (the spacer layer) to the area above interstitial conductor 1003 (the dielectric layer) via reflection. In one example, the angle of sides 1007 and 1008 are at 45° angles. In an alternative example, sides 1007 and 1008 could be replaced with a continuous radius to achieve the reflection. While FIG. 10A shows angled sides that have angle of 45 degrees, other angles that accomplish signal transmission from lower level feed to upper level feed may be used. That is, given that the effective wavelength in the lower feed will generally be different than in the upper feed, some deviation from the ideal 45° angles could be used to aid transmission from the lower to the upper feed level.

In operation, when a feed wave is fed in from coaxial pin 1001, the wave travels outward concentrically oriented from coaxial pin 1001 in the area between ground plane 1002 and interstitial conductor 1003. The concentrically outgoing waves are reflected by sides 1007 and 1008 and travel inwardly in the area between interstitial conductor 1003 and RF array 1006. The reflection from the edge of the circular perimeter causes the wave to remain in phase (i.e., it is an in-phase reflection). The travelling wave is slowed by dielectric layer 1005. At this point, the travelling wave starts interacting and exciting with elements in RF array 1006 to obtain the desired scattering.

To terminate the travelling wave, a termination 1009 is included in the antenna at the geometric center of the antenna. In one example, termination 1009 comprises a pin termination (e.g., a 50Ω pin). In another example, termination 1009 comprises an RF absorber that terminates unused energy to prevent reflections of that unused energy back through the feed structure of the antenna. These could be used at the top of RF array 1006.

FIG. 10B illustrates another example of the antenna system with an outgoing wave. Referring to FIG. 10B, two ground planes 1010 and 1011 are substantially parallel to each other with a dielectric layer 1012 (e.g., a plastic layer, etc.) in between ground planes 1010 and 1011. RF absorbers 1013 and 1014 (e.g., resistors) couple the two ground planes 1010 and 1011 together. A coaxial pin 1015 (e.g., 50Ω) feeds the antenna. An RF array 1016 is on top of dielectric layer 1012.

In operation, a feed wave is fed through coaxial pin 1015 and travels concentrically outward and interacts with the elements of RF array 1016.

The cylindrical feed in both the antennas of FIGS. 10A and 10B improves the service angle of the antenna. Instead of a service angle of plus or minus forty-five degrees azimuth (±45° Az) and plus or minus twenty-five degrees elevation (±25° El), in one example, the antenna system has a service angle of seventy-five degrees (75°) from the bore sight in all directions. As with any beam forming antenna comprised of many individual radiators, the overall antenna gain is dependent on the gain of the constituent elements, which themselves are angle-dependent. When using common radiating elements, the overall antenna gain typically decreases as the beam is pointed further off bore sight. At 75 degrees off bore sight, significant gain degradation of about 6 dB is expected.

Examples of the antenna having a cylindrical feed solve one or more problems. These include dramatically simplifying the feed structure compared to antennas fed with a corporate divider network and therefore reducing total required antenna and antenna feed volume; decreasing sensitivity to manufacturing and control errors by maintaining high beam performance with coarser controls (extending all the way to simple binary control); giving a more advantageous side lobe pattern compared to rectilinear feeds because the cylindrically oriented feed waves result in spatially diverse side lobes in the far field; and allowing polarization to be dynamic, including allowing left-hand circular, right-hand circular, and linear polarizations, while not requiring a polarizer.

Array of Wave Scattering Elements

RF array 1006 of FIG. 10A and RF array 1016 of FIG. 10B include a wave scattering subsystem that includes a group of patch antennas (i.e., scatterers) that act as radiators. This group of patch antennas comprises an array of scattering metamaterial elements.

In one example, each scattering element in the antenna system is part of a unit cell that consists of a lower conductor, a dielectric substrate and an upper conductor that embeds a complementary electric inductive-capacitive resonator ("complementary electric LC" or "CELC") that is etched in or deposited onto the upper conductor.

In one example, a liquid crystal (LC) is injected in the gap around the scattering element. Liquid crystal is encapsulated in each unit cell and separates the lower conductor associated with a slot from an upper conductor associated with its patch. Liquid crystal has a permittivity that is a function of the orientation of the molecules comprising the liquid crystal, and the orientation of the molecules (and thus the permittivity) can be controlled by adjusting the bias voltage across the liquid crystal. Using this property, the liquid crystal acts as an on/off switch for the transmission of energy from the guided wave to the CELC. When switched on, the CELC emits an electromagnetic wave like an electrically small dipole antenna.

Controlling the thickness of the LC increases the beam switching speed. A fifty percent (50%) reduction in the gap between the lower and the upper conductor (the thickness of the liquid crystal) results in a fourfold increase in speed. In another example, the thickness of the liquid crystal results in a beam switching speed of approximately fourteen milliseconds (14 ms). In one example, the LC is doped in a manner well-known in the art to improve responsiveness so that a seven millisecond (7 ms) requirement can be met.

The CELC element is responsive to a magnetic field that is applied parallel to the plane of the CELC element and perpendicular to the CELC gap complement. When a voltage is applied to the liquid crystal in the metamaterial scattering unit cell, the magnetic field component of the guided wave induces a magnetic excitation of the CELC, which, in turn, produces an electromagnetic wave in the same frequency as the guided wave.

The phase of the electromagnetic wave generated by a single CELC can be selected by the position of the CELC on the vector of the guided wave. Each cell generates a wave in phase with the guided wave parallel to the CELC. Because the CELCs are smaller than the wave length, the output wave has the same phase as the phase of the guided wave as it passes beneath the CELC.

In one example, the cylindrical feed geometry of this antenna system allows the CELC elements to be positioned at forty-five degree (45°) angles to the vector of the wave in the wave feed. This position of the elements enables control of the polarization of the free space wave generated from or received by the elements. In one example, the CELCs are arranged with an inter-element spacing that is less than a free-space wavelength of the operating frequency of the antenna. For example, if there are four scattering elements per wavelength, the elements in the 30 GHz transmit antenna will be approximately 2.5 mm (i.e., ¼th the 10 mm free-space wavelength of 30 GHz).

In one example, the CELCs are implemented with patch antennas that include a patch co-located over a slot with liquid crystal between the two. In this respect, the metamaterial antenna acts like a slotted (scattering) wave guide. With a slotted wave guide, the phase of the output wave depends on the location of the slot in relation to the guided wave.

Cell Placement

Figure 21:
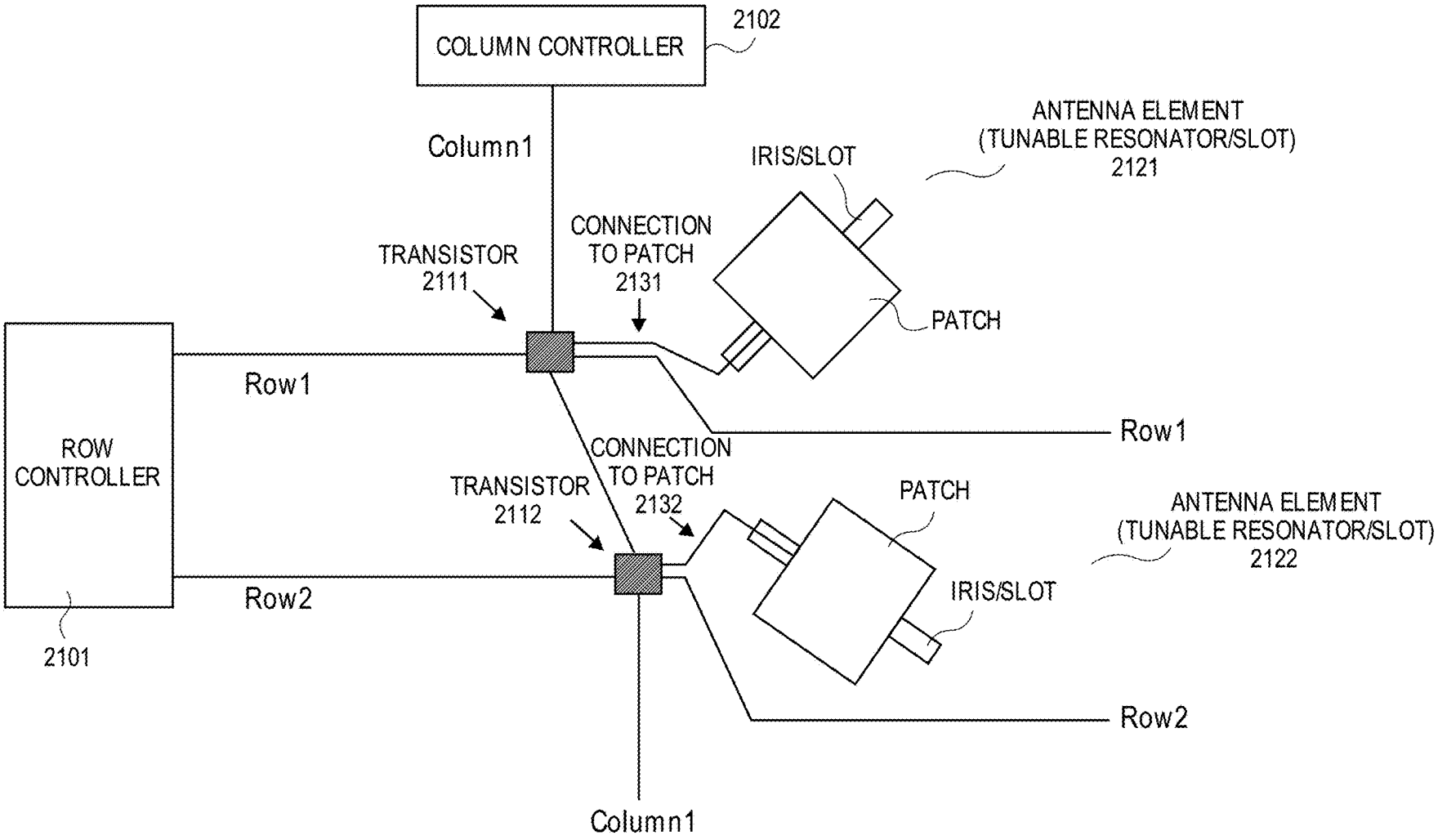
FIG. 21 illustrates one example of the placement of matrix drive circuitry with respect to antenna elements.

In one example, the antenna elements are placed on the cylindrical feed antenna aperture in a way that allows for a systematic matrix drive circuit. The placement of the cells includes placement of the transistors for the matrix drive. FIG. 21 illustrates one example of the placement of matrix drive circuitry with respect to antenna elements. Referring to FIG. 21, row controller 2101 is coupled to transistors 2111 and 2112, via row select signals Row1 and Row2, respectively, and column controller 2102 is coupled to transistors 2111 and 2112 via column select signal Column1. Transistor 2111 is also coupled to antenna element 2121 via connection to patch 2131, while transistor 2112 is coupled to antenna element 2122 via connection to patch 2132.

In an initial approach to realize matrix drive circuitry on the cylindrical feed antenna with unit cells placed in a non-regular grid, two steps are performed. In the first step, the cells are placed on concentric rings and each of the cells is connected to a transistor that is placed beside the cell and acts as a switch to drive each cell separately. In the second step, the matrix drive circuitry is built in order to connect every transistor with a unique address as the matrix drive approach requires. Because the matrix drive circuit is built by row and column traces (similar to LCDs) but the cells are placed on rings, there is no systematic way to assign a unique address to each transistor. This mapping problem results in very complex circuitry to cover all the transistors and leads to a significant increase in the number of physical traces to accomplish the routing. Because of the high density of cells, those traces disturb the RF performance of the antenna due to coupling effect. Also, due to the complexity of traces and high packing density, the routing of the traces cannot be accomplished by commercial available layout tools.

In one example, the matrix drive circuitry is predefined before the cells and transistors are placed. This ensures a minimum number of traces that are necessary to drive all the cells, each with a unique address. This strategy reduces the complexity of the drive circuitry and simplifies the routing, which subsequently improves the RF performance of the antenna.

More specifically, in one approach, in the first step, the cells are placed on a regular rectangular grid composed of rows and columns that describe the unique address of each cell. In the second step, the cells are grouped and transformed to concentric circles while maintaining their address and connection to the rows and columns as defined in the first step. A goal of this transformation is not only to put the cells on rings but also to keep the distance between cells and the distance between rings constant over the entire aperture. In order to accomplish this goal, there are several ways to group the cells.

Figure 11:
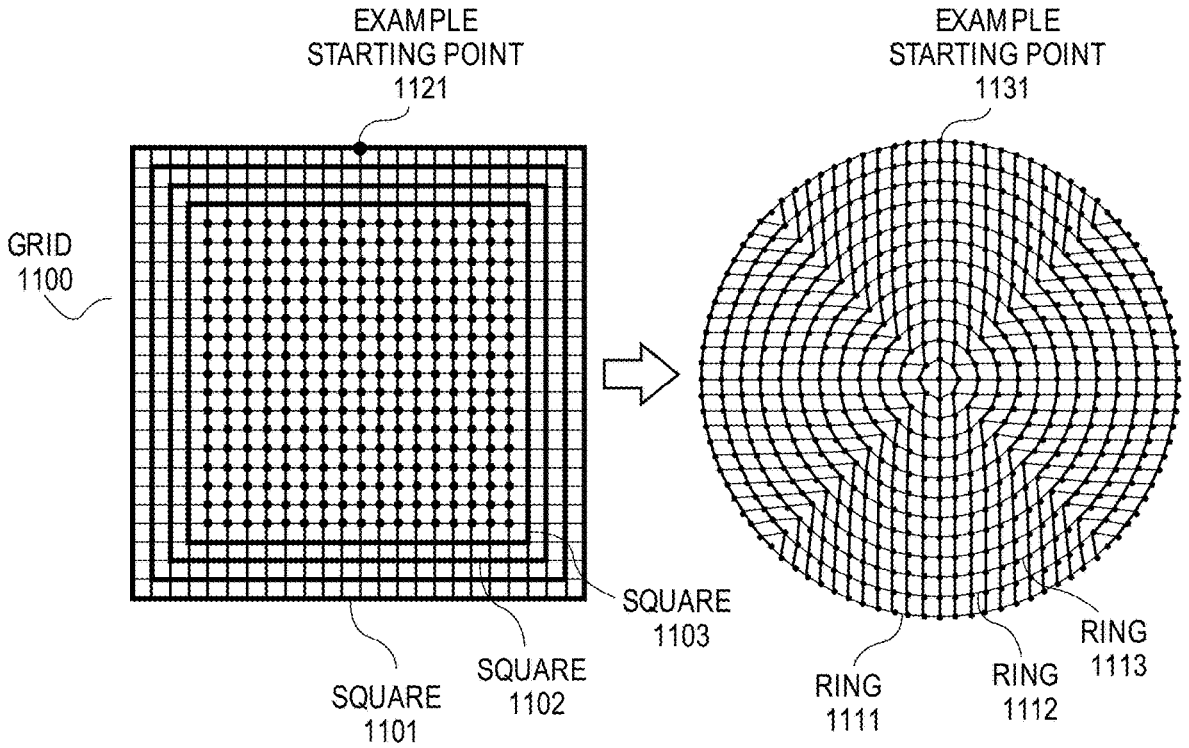
FIG. 11 shows an example where cells are grouped to form concentric squares (rectangles).

FIG. 11 shows an example where cells are grouped to form concentric squares (rectangles). Referring to FIG. 11, squares 1101-1103 are shown on the grid 1100 of rows and columns. In these examples, the squares and not all of the squares create the cell placement on the right side of FIG. 7. Each of the squares, such as squares 1101-1103, are then, through a mathematical conformal mapping process, transformed into rings, such as rings 1111-1113 of antenna elements. For example, the outer ring 1111 is the transformation of the outer square 1101 on the left.

The density of the cells after the transformation is determined by the number of cells that the next larger square contains in addition to the previous square. In one example, using squares results in the number of additional antenna elements, $\Delta N$, to be 8 additional cells on the next larger square. In one example, this number is constant for the entire aperture. In one example, the ratio of cellpitch1 (CP1: ring to ring distance) to cellpitch2 (CP2: distance cell to cell along a ring) is given by:

$$CP1CP2 = \frac{\Delta N}{2\pi}$$

Thus, CP2 is a function of CP1 (and vice versa). The cell pitch ratio for the example in FIG. 7 is then $$\frac{CP1}{CP2} = \frac{8}{2\pi} = 1.2732$$

which means that the CP1 is larger than CP2.

In one example, to perform the transformation, a starting point on each square, such as starting point 1121 on square 1101, is selected and the antenna element associated with that starting point is placed on one position of its corresponding ring, such as starting point 1131 on ring 1111. For example, the x-axis or y-axis may be used as the starting point. Thereafter, the next element on the square proceeding in one direction (clockwise or counterclockwise) from the starting point is selected and that element placed on the next location on the ring going in the same direction (clockwise or counterclockwise) that was used in the square. This process is repeated until the locations of all the antenna elements have been assigned positions on the ring. This entire square to ring transformation process is repeated for all squares.

Figure 12:
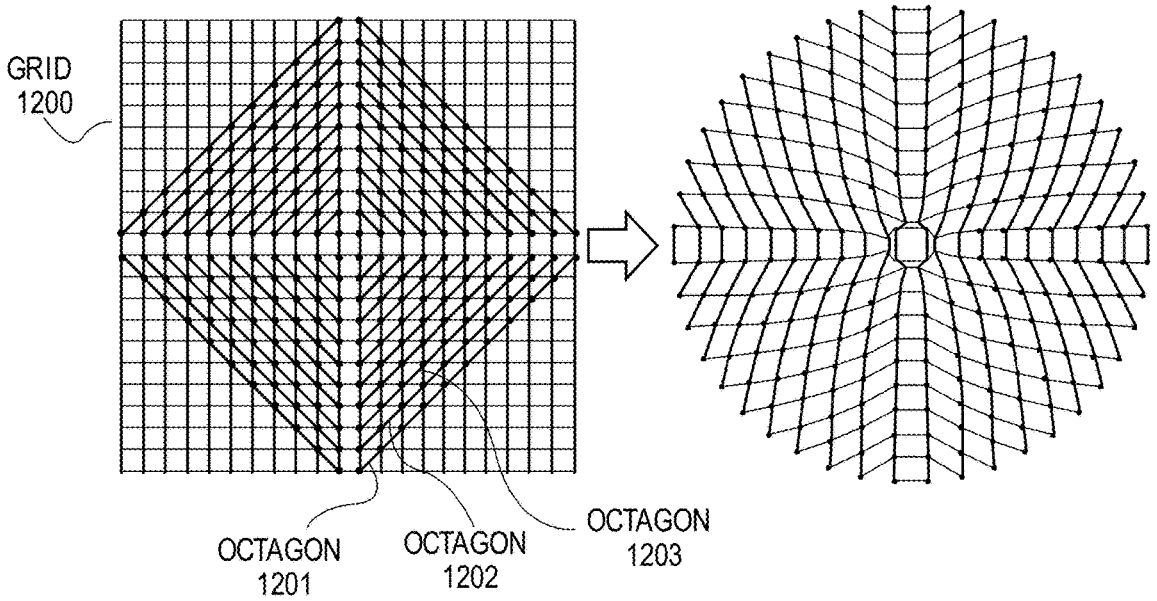
FIG. 12 shows an example where cells are grouped to form concentric octagons.

However, according to analytical studies and routing constraints, it is preferred to apply a CP2 larger than CP1. To accomplish this, a second strategy shown in FIG. 12 is used. Referring to FIG. 12, the cells are grouped initially into octagons, such as octagons 1201-1203, with respect to a grid 1200. By grouping the cells into octagons, the number of additional antenna elements ΔN equals 4, which gives a ratio:

$$CP1CP2 = \frac{4}{2\pi} = 0.6366$$

which results in CP2>CP1. The transformation from octagon to concentric rings for cell placement according to FIG. 12 can be performed in the same manner as that described above with respect to FIG. 11 by initially selecting a starting point.

In one example, the cell placements disclosed with respect to FIGS. 11 and 12 have a number of features. These features include:

1) A constant CP1/CP2 over the entire aperture (Note that in one example an antenna that is substantially constant (e.g., being 90% constant) over the aperture will still function);
2) CP2 is a function of CP1;
3) There is a constant increase per ring in the number of antenna elements as the ring distance from the centrally located antenna feed increases;
4) All the cells are connected to rows and columns of the matrix;
5) All the cells have unique addresses;
6) The cells are placed on concentric rings; and There is rotational symmetry in that the four quadrants are identical and a ¼ wedge can be rotated to build out the array. This is beneficial for segmentation.

In other examples, while two shapes are given, any shapes may be used. Other increments are also possible (e.g., 6 increments).

Figure 13:
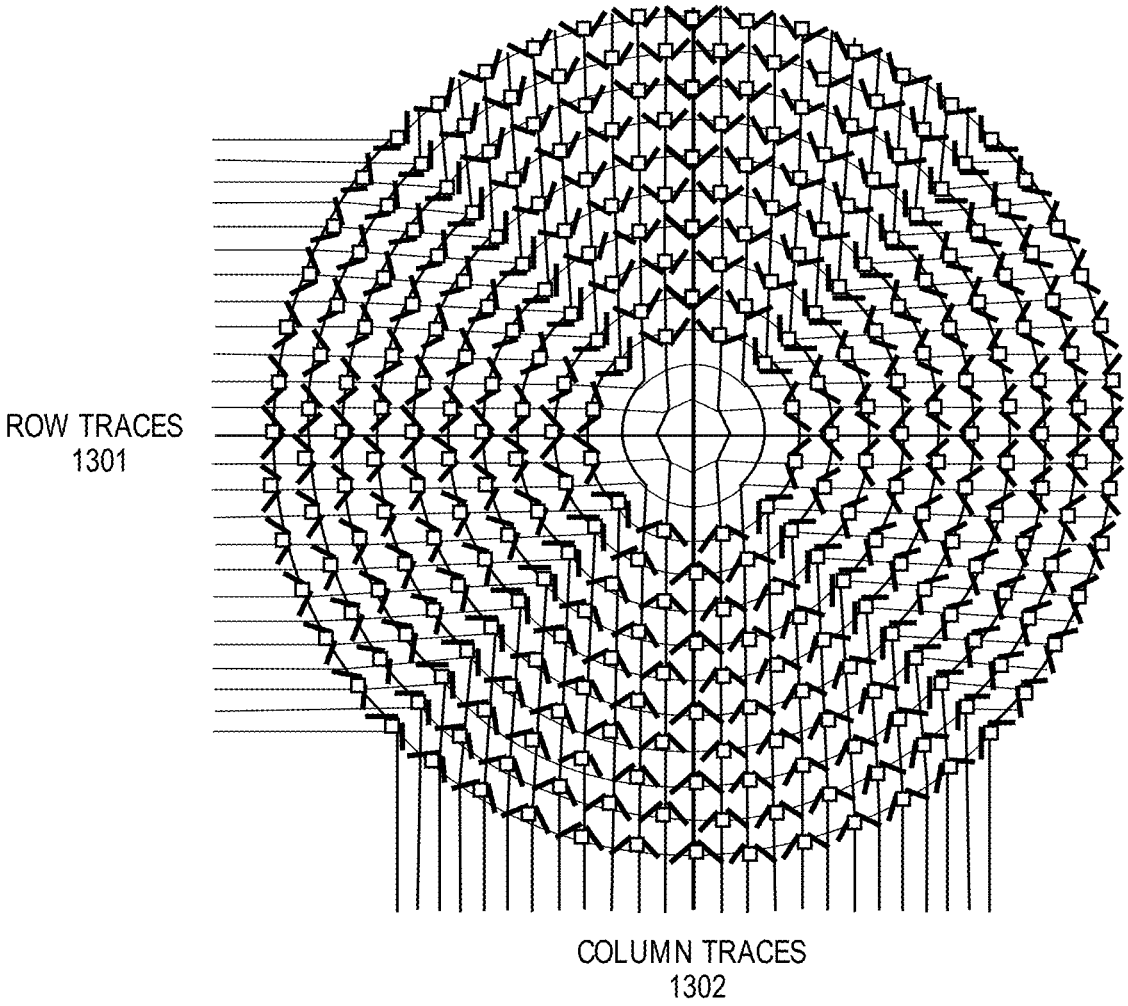
FIG. 13 shows an example of a small aperture including the irises and the matrix drive circuitry.

FIG. 13 shows an example of a small aperture including the irises and the matrix drive circuitry. The row traces 1301 and column traces 1302 represent row connections and column connections, respectively. These lines describe the matrix drive network and not the physical traces (as physical traces may have to be routed around antenna elements, or parts thereof). The square next to each pair of irises is a transistor.

FIG. 13 also shows the potential of the cell placement technique for using dual-transistors where each component drives two cells in a PCB array. In this case, one discrete device package contains two transistors, and each transistor drives one cell.

Figure 22:
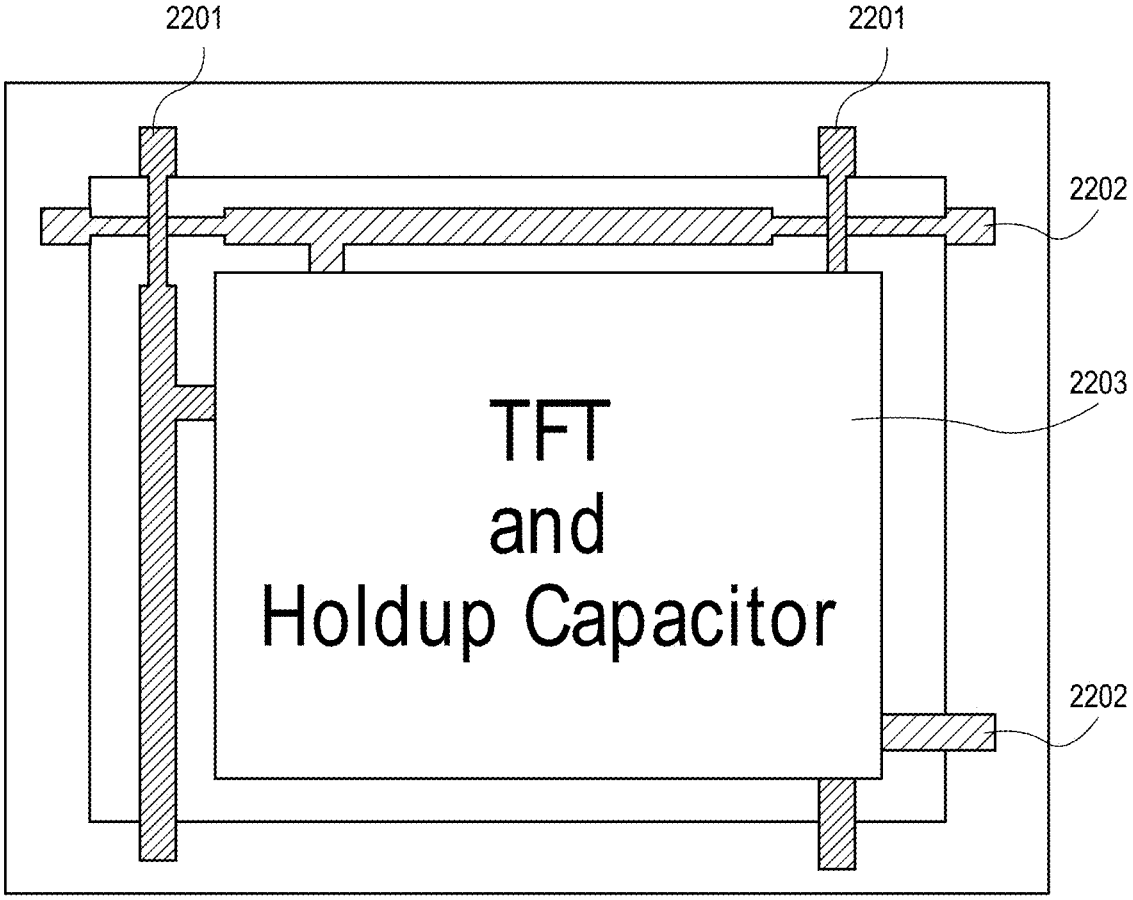
FIG. 22 illustrates one example of a TFT package.

In one example, a TFT package is used to enable placement and unique addressing in the matrix drive. FIG. 22 illustrates one example of a TFT package. Referring to FIG. 22, a TFT and a hold capacitor 2203 is shown with input and output ports. There are two input ports connected to traces 2201 and two output ports connected to traces 2202 to connect the TFTs together using the rows and columns. In one example, the row and column traces cross in 90° angles to reduce, and potentially minimize, the coupling between the row and column traces. In one example, the row and column traces are on different layers.

Another feature of the proposed cell placement shown in FIGS. 11-13 is that the layout is a repeating pattern in which each quarter of the layout is the same as the others. This allows the sub-section of the array to be repeated rotation-wise around the location of the central antenna feed, which in turn allows a segmentation of the aperture into sub-apertures. This helps in fabricating the antenna aperture.

In another example, the matrix drive circuitry and cell placement on the cylindrical feed antenna is accomplished in a different manner. To realize matrix drive circuitry on the cylindrical feed antenna, a layout is realized by repeating a subsection of the array rotation-wise. This example also allows the cell density that can be used for illumination tapering to be varied to improve the RF performance.

Figure 14:
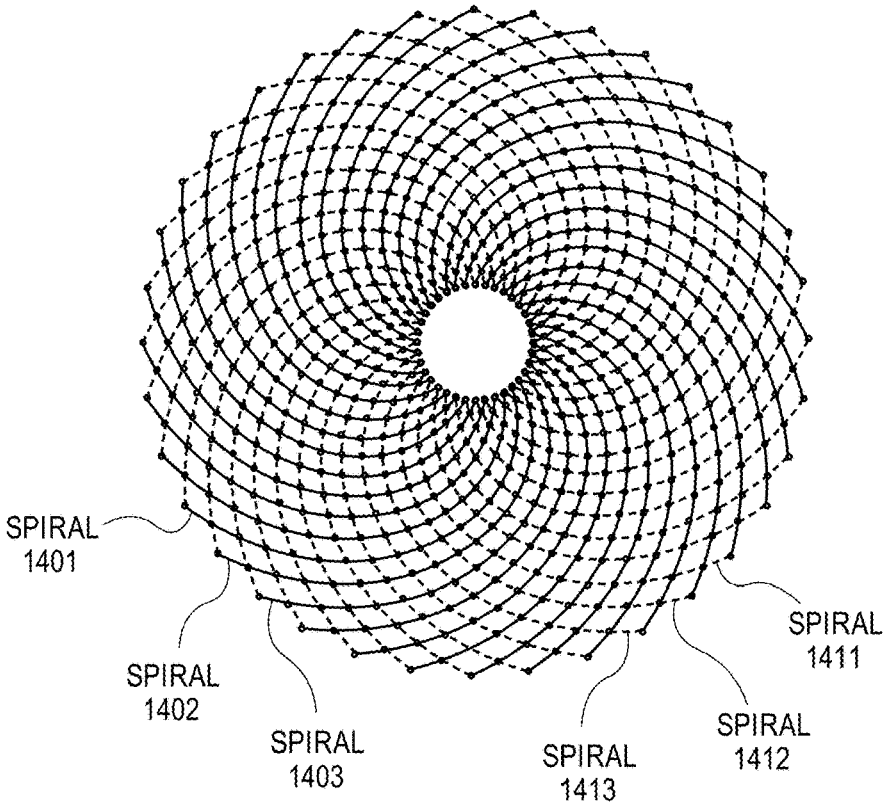
FIG. 14 shows an example of lattice spirals used for cell placement.

In this alternative approach, the placement of cells and transistors on a cylindrical feed antenna aperture is based on a lattice formed by spiral shaped traces. FIG. 14 shows an example of such lattice clockwise spirals, such as spirals 1401-1403, which bend in a clockwise direction and the spirals, such as spirals 1411-1413, which bend in a clockwise, or opposite, direction. The different orientation of the spirals results in intersections between the clockwise and counterclockwise spirals. The resulting lattice provides a unique address given by the intersection of a counterclockwise trace and a clockwise trace and can therefore be used as a matrix drive lattice. Furthermore, the intersections can be grouped on concentric rings, which is crucial for the RF performance of the cylindrical feed antenna.

Unlike the approaches for cell placement on the cylindrical feed antenna aperture discussed above, the approach discussed above in relation to FIG. 14 provides a non-uniform distribution of the cells. As shown in FIG. 14, the distance between the cells increases with the increase in radius of the concentric rings. In one example, the varying density is used as a method to incorporate an illumination tapering under control of the controller for the antenna array.

Figure 15:
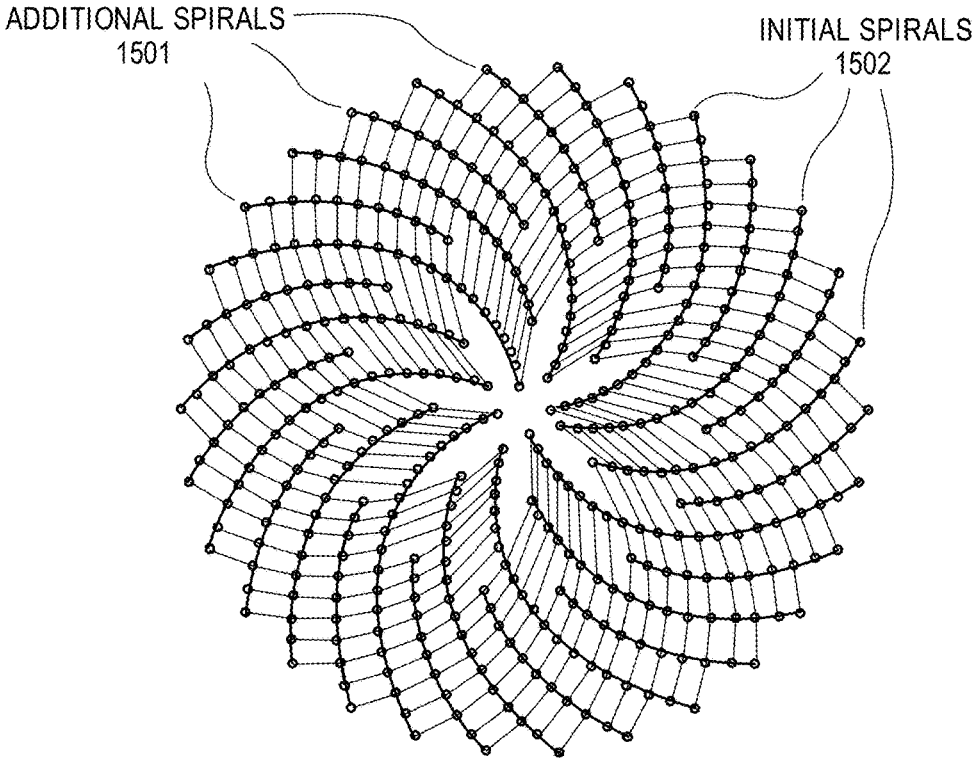
FIG. 15 shows an example of cell placement that uses additional spirals to achieve a more uniform density.

Due to the size of the cells and the required space between them for traces, the cell density cannot exceed a certain number. In one example, the distance is ⅕ based on the frequency of operation. As described above, other distances may be used. In order to avoid an overpopulated density close to the center, or in other words to avoid an under-population close to the edge, additional spirals can be added to the initial spirals as the radius of the successive concentric rings increases. FIG. 15 shows an example of cell placement that uses additional spirals to achieve a more uniform density. Referring to FIG. 15, additional spirals, such as additional spirals 1501, are added to the initial spirals, such as spirals 1502, as the radius of the successive concentric rings increases. According to analytical simulations, this approach provides an RF performance that converges the performance of an entirely uniform distribution of cells. In one example, this design provides a better side lobe behavior because of the tapered element density than some examples described above.

Figure 16:
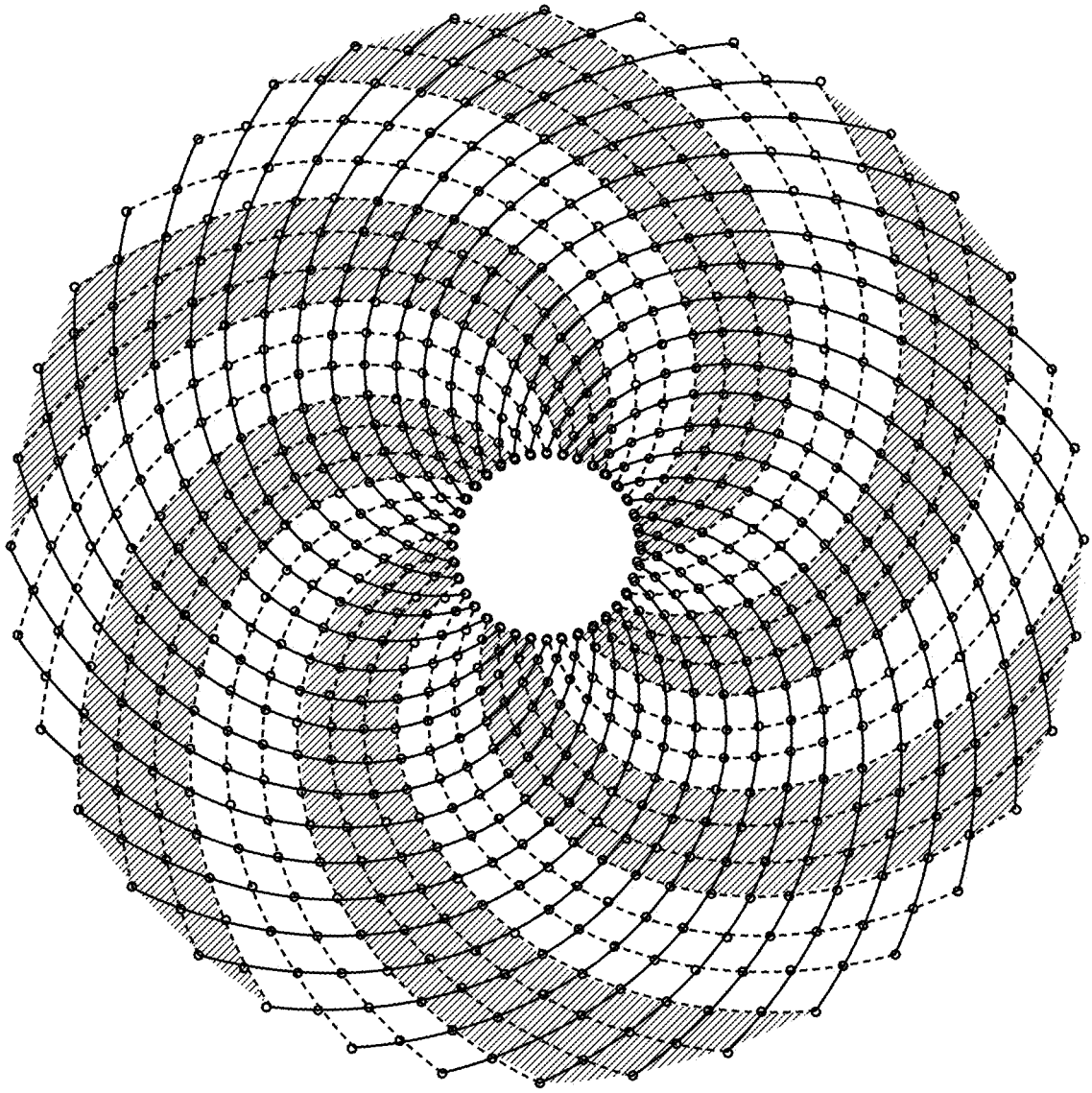
FIG. 16 illustrates a selected pattern of spirals that is repeated to fill the entire aperture according to one example.

Another advantage of the use of spirals for cell placement is the rotational symmetry and the repeatable pattern which can simplify the routing efforts and reducing fabrication costs. FIG. 16 illustrates a selected pattern of spirals that is repeated to fill the entire aperture.

In one example, the cell placements disclosed with respect to FIGS. 14-16 have a number of features. These features include:

1) CP1/CP2 is not over the entire aperture;
2) CP2 is a function of CP1;
3) There is no increase per ring in the number of antenna elements as the ring distance from the centrally located antenna feed increases;
4) All the cells are connected to rows and columns of the matrix;
5) All the cells have unique addresses;
6) The cells are placed on concentric rings; and
7) There is rotational symmetry (as described above).

Thus, the cell placement examples described above in conjunction with FIGS. 14-16 have many similar features to the cell placement examples described above in conjunction with FIGS. 11-13.

Aperture Segmentation

In one example, the antenna aperture is created by combining multiple segments of antenna elements together. This requires that the array of antenna elements be segmented and the segmentation ideally requires a repeatable footprint pattern of the antenna. In one example, the segmentation of a cylindrical feed antenna array occurs such that the antenna footprint does not provide a repeatable pattern in a straight and inline fashion due to the different rotation angles of each radiating element. One goal of the segmentation approach disclosed herein is to provide segmentation without compromising the radiation performance of the antenna.

While segmentation techniques described herein focuses improving, and potentially maximizing, the surface utilization of industry standard substrates with rectangular shapes, the segmentation approach is not limited to such substrate shapes.

In one example, segmentation of a cylindrical feed antenna is performed in a way that the combination of four segments realize a pattern in which the antenna elements are placed on concentric and closed rings. This aspect is important to maintain the RF performance. Furthermore, in one example, each segment requires a separate matrix drive circuitry.

Figure 17:
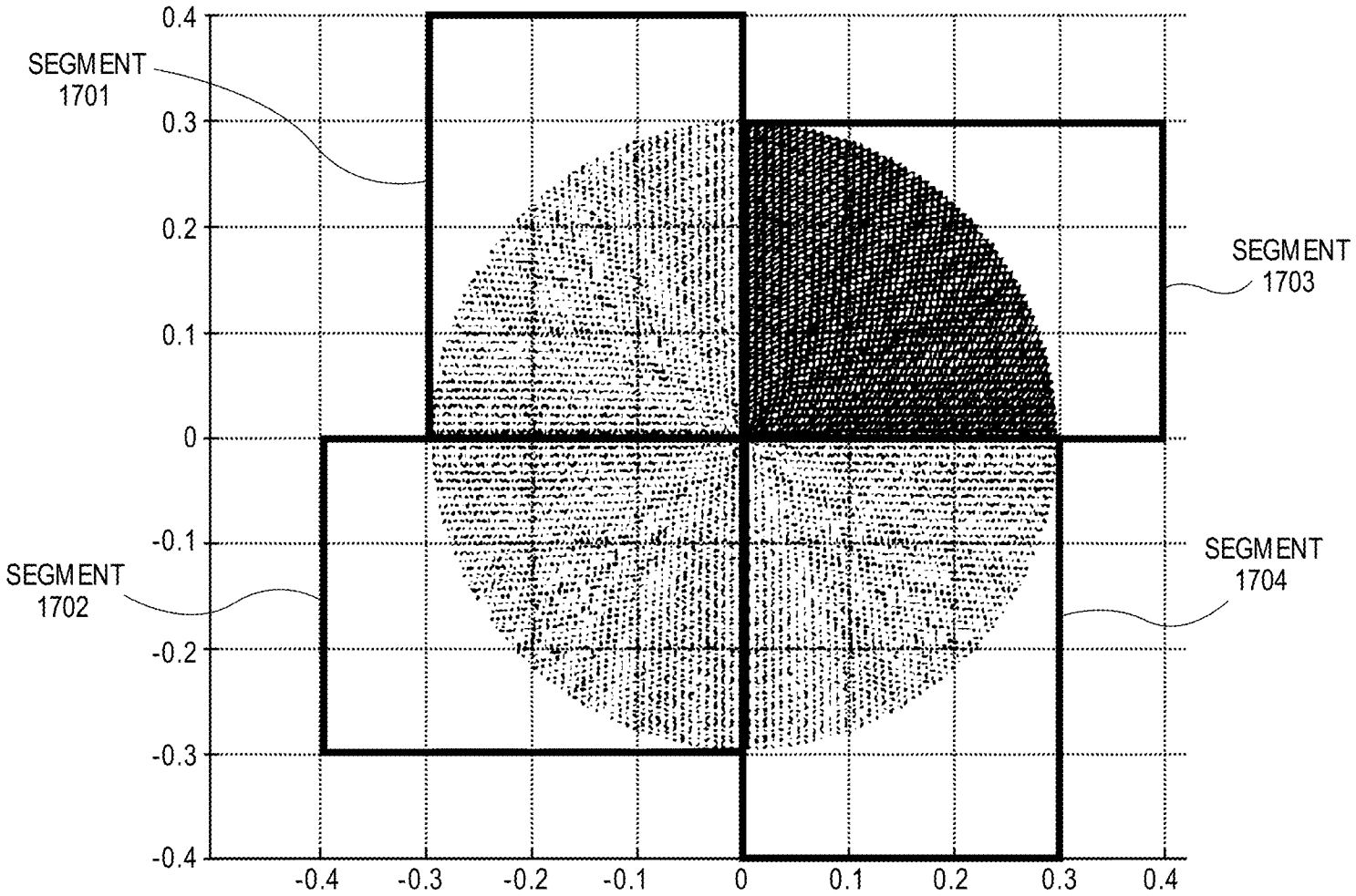
FIG. 17 illustrates one embodiment of segmentation of a cylindrical feed aperture into quadrants according to one example.

FIG. 17 illustrates segmentation of a cylindrical feed aperture into quadrants. Referring to FIG. 17, segments 1701-1704 are identical quadrants that are combined to build a round antenna aperture. The antenna elements on each of segments 1701-1704 are placed in portions of rings that form concentric and closed rings when segments 1701-1704 are combined. To combine the segments, segments are mounted or laminated to a carrier. In another example, overlapping edges of the segments are used to combine them together. In this case, in one example, a conductive bond is created across the edges to prevent RF from leaking. Note that the element type is not affected by the segmentation.

As the result of this segmentation method illustrated in FIG. 17, the seams between segments 1701-1704 meet at the center and go radially from the center to the edge of the antenna aperture. This configuration is advantageous since the generated currents of the cylindrical feed propagate radially and a radial seam has a low parasitic impact on the propagated wave.

Figure 18B:
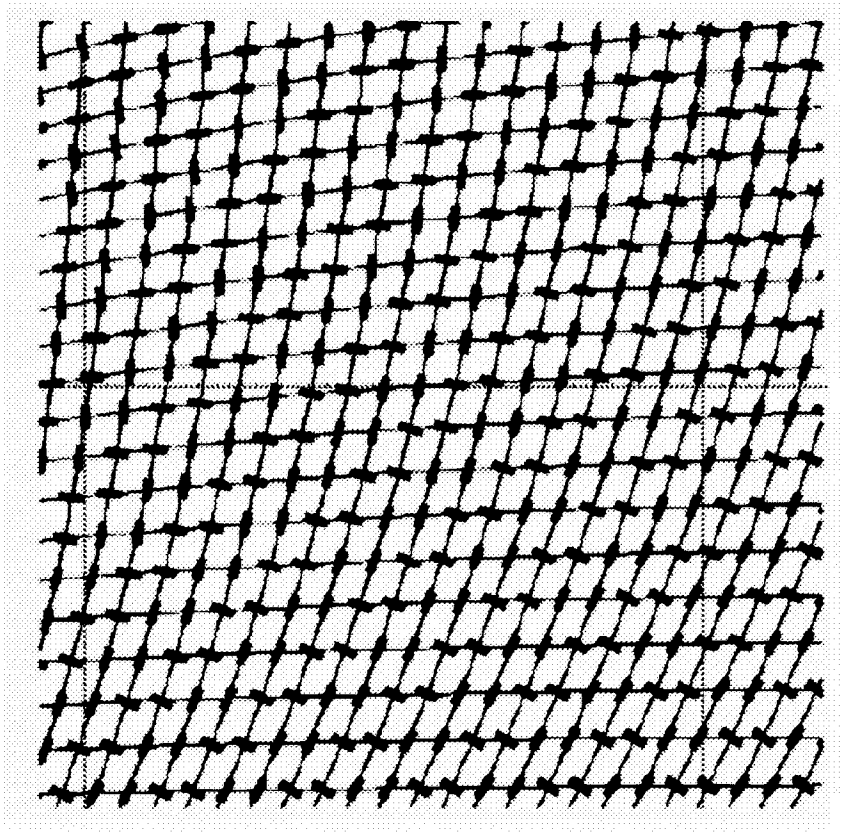
FIGS. 18A and 18B illustrate a single segment of FIG. 17 with the applied matrix drive lattice according to one example.
Figure 18A:
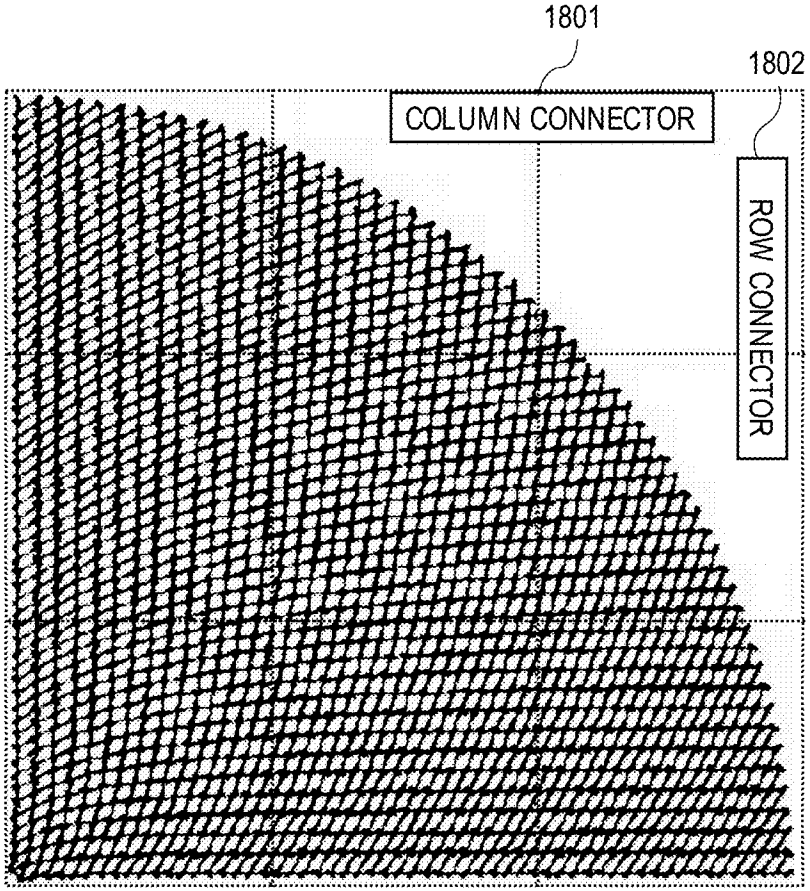

As shown in FIG. 17, rectangular substrates, which are a standard in the LCD industry, can also be used to realize an aperture. FIGS. 18A and 18B illustrate a single segment of FIG. 17 with the applied matrix drive lattice. The matrix drive lattice assigns a unique address to each of transistor. Referring to FIGS. 18A and 18B, a column connector 1801 and row connector 1802 are coupled to drive lattice lines. FIG. 18B also shows irises coupled to lattice lines.

Figure 19:
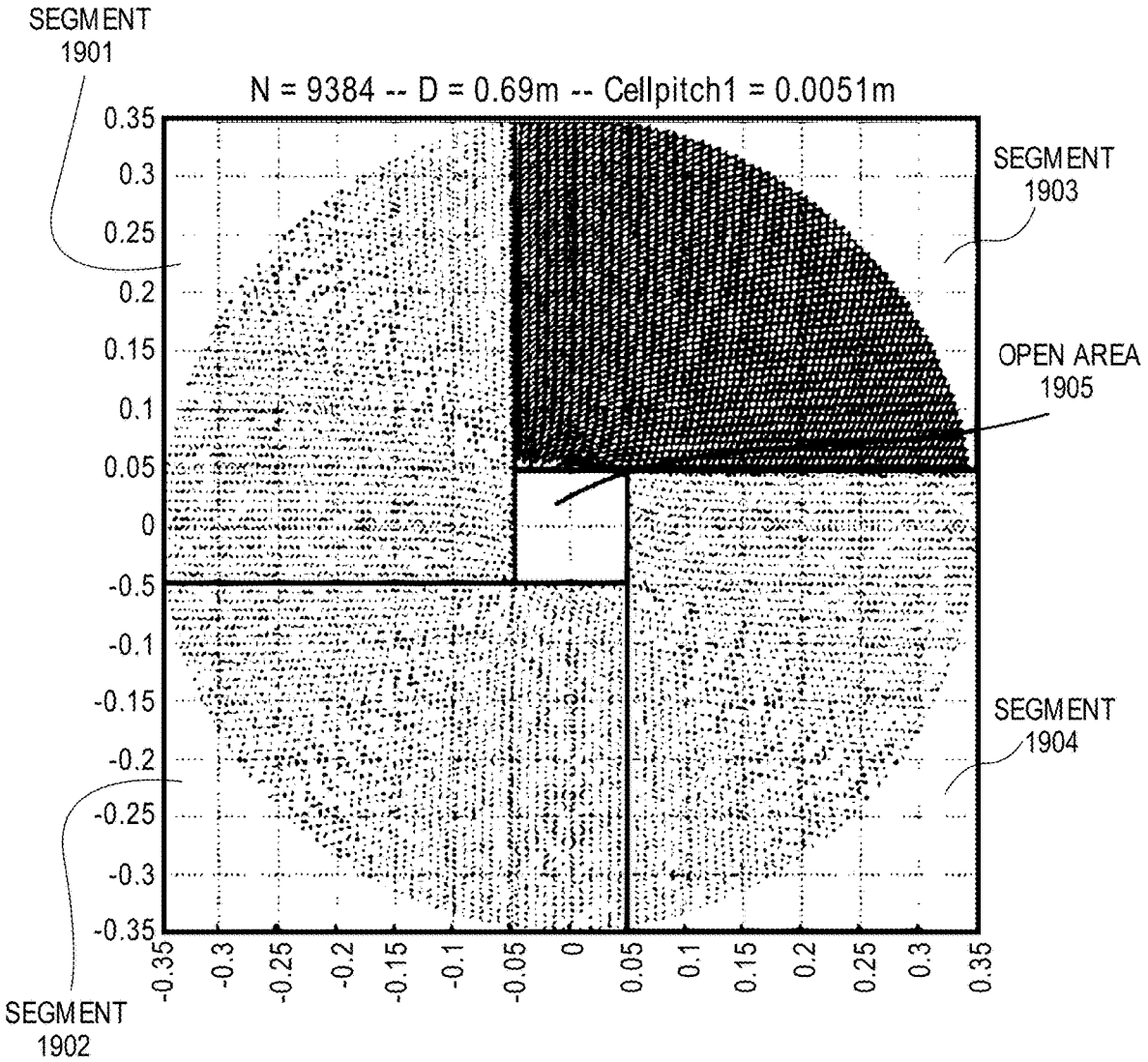
FIG. 19 illustrates another example of segmentation of a cylindrical feed aperture into quadrants.

As is evident from FIG. 17, a large area of the substrate surface cannot be populated if a non-square substrate is used. In order to have a more efficient usage of the available surface on a non-square substrate, in another example, the segments are on rectangular boards but utilize more of the board space for the segmented portion of the antenna array. One example of such an example is shown in FIG. 19. Referring to FIG. 19, the antenna aperture is created by combining segments 1901-1904, which comprises substrates (e.g., boards) with a portion of the antenna array included therein. While each segment does not represent a circle quadrant, the combination of four segments 1901-1904 closes the rings on which the elements are placed. That is, the antenna elements on each of segments 1901-1904 are placed in portions of rings that form concentric and closed rings when segments 1901-1904 are combined. In one example, the substrates are combined in a sliding tile fashion, so that the longer side of the non-square board introduces a rectangular open area 1905. Open area 1905 is where the centrally located antenna feed is located and included in the antenna.

The antenna feed is coupled to the rest of the segments when the open area exists because the feed comes from the bottom, and the open area can be closed by a piece of metal to prevent radiation from the open area. A termination pin may also be used.

The use of substrates in this fashion allows use of the available surface area more efficiently and results in an increased aperture diameter.

Figure 20B:
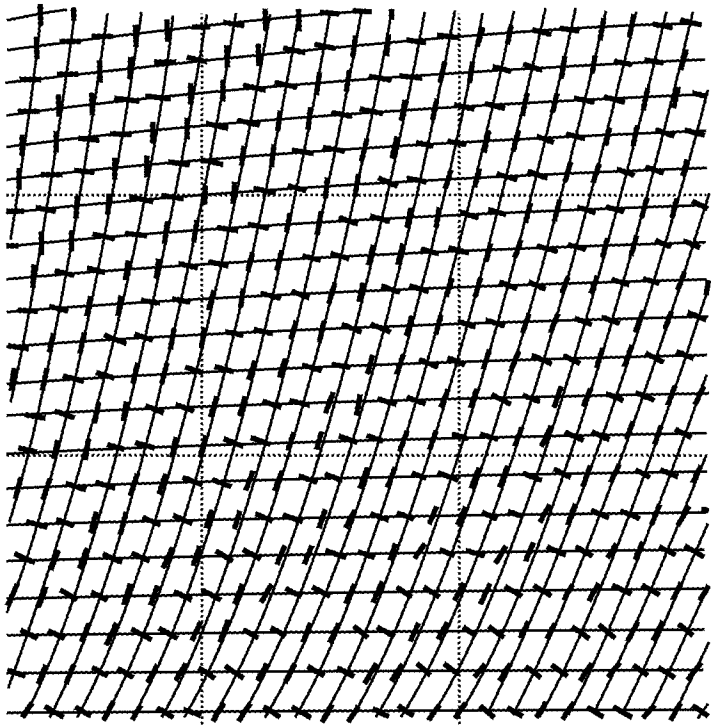
FIGS. 20A and 20B illustrate a single segment of FIG. 19 with the applied matrix drive lattice.
Figure 20A:
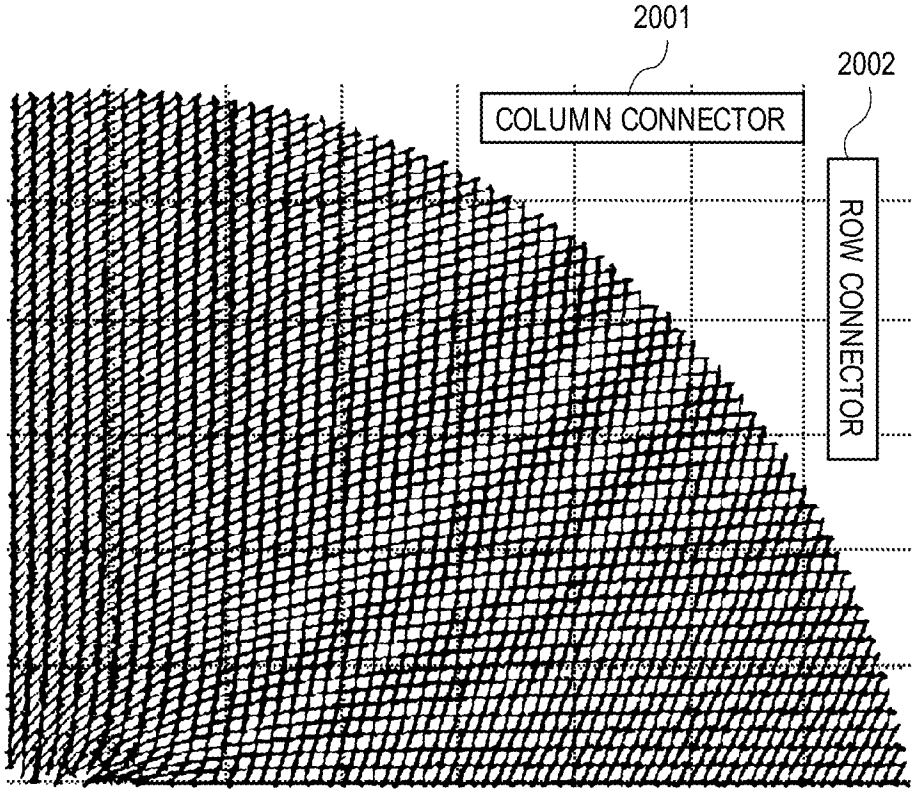

Similar to the example shown in FIGS. 17, 18A and 18B, this example allows use of a cell placement strategy to obtain a matrix drive lattice to cover each cell with a unique address. FIGS. 20A and 20B illustrate a single segment of FIG. 19 with the applied matrix drive lattice. The matrix drive lattice assigns a unique address to each of transistor. Referring to FIGS. 20A and 20B, a column connector 2001 and row connector 2002 are coupled to drive lattice lines. FIG. 20B also shows irises.

For both approaches described above, the cell placement may be performed based on a recently disclosed approach which allows the generation of matrix drive circuitry in a systematic and predefined lattice, as described above.

Figure 23B:
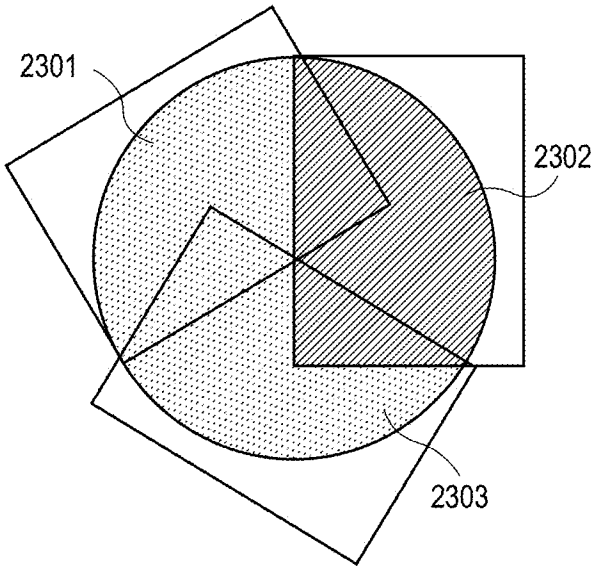
FIGS. 23A and 23B illustrate one example of an antenna aperture with an odd number of segments.
Figure 23A:
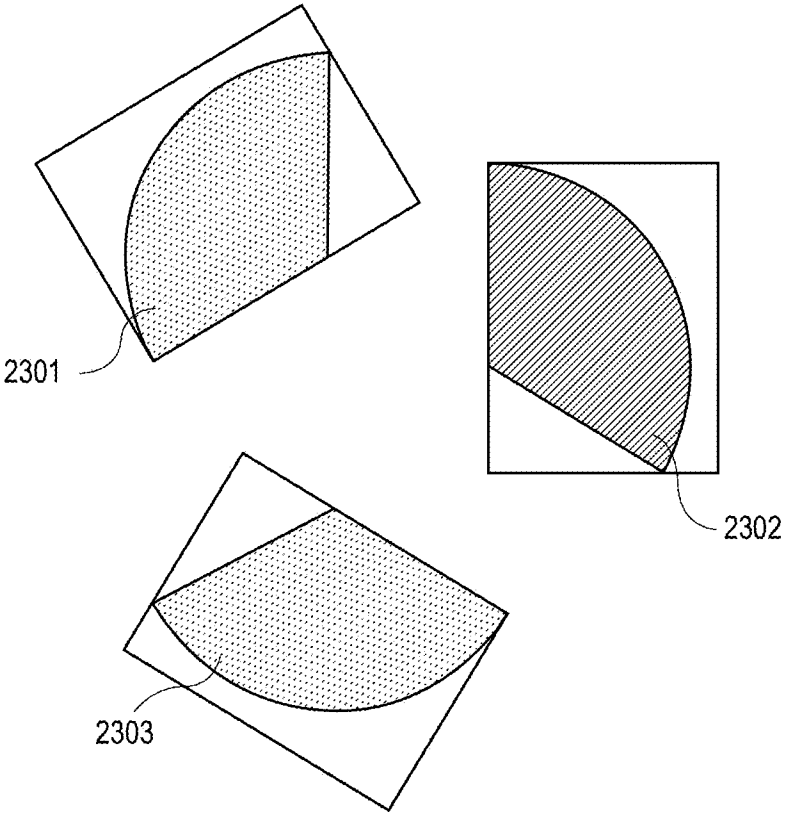

While the segmentations of the antenna arrays above are into four segments, this is not a requirement. The arrays may be divided into an odd number of segments, such as, for example, three segments or five segments. FIGS. 23A and 23B illustrate one example of an antenna aperture with an odd number of segments. Referring to FIG. 23A, there are three segments, segments 2301-2303, that are not combined. Referring to FIG. 23B, the three segments, segments 2301-2303, when combined, form the antenna aperture. These arrangements are not advantageous because the seams of all the segments do not go all the way through the aperture in a straight line. However, they do mitigate side lobes.

Whereas many alterations and modifications of the present invention will no doubt become apparent to a person of ordinary skill in the art after having read the foregoing description, it is to be understood that any particular example shown and described by way of illustration is in no way intended to be considered limiting. Therefore, references to details of various examples are not intended to limit the scope of the claims which in themselves recite only those features regarded as essential to the invention.

What is claimed is:

1. An antenna comprising:

a first surface having antenna elements; and a guided wave transmission line to provide a guided feed wave to the first surface, wherein the guided wave transmission line comprises a coupling surface to change power distribution of the guided feed wave to make the power distribution of the guided feed wave more uniform.

2. The antenna of claim 1, wherein the coupling surface is to control coupling of the guided feed wave to the antenna elements.

3. The antenna of claim 2, wherein the coupling surface is to control vertical coupling or lateral coupling of the guided feed wave to the antenna elements.

4. The antenna of claim 1, wherein the coupling surface is to spatially filter the guided feed wave to provide a more uniform power density for the antenna elements than provided by the guided feed wave without filtering by the filter.

5. The antenna of claim 4, wherein the guided feed wave is a high-power-density electromagnetic wave or a high-power-density, radially decaying electromagnetic wave.

6. The antenna of claim 1, wherein the coupling surface is configured to a desired coupling rate or for optimized coupling curves for the antenna based on ordinary differential equations (ODE) to change the power distribution of the guided feed wave in order to provide for a more uniform aperture distribution for the antenna than would be provided with the guided feed wave without changing the power distribution.

7. The antenna of claim 1, wherein the guided wave transmission line comprises an edge-fed cylindrical waveguide, a center-fed cylindrical waveguide, a linear waveguide, or a stripline transmission line.

8. The antenna of claim 7, wherein any of the waveguides comprises a top waveguide and a bottom waveguide.

9. The antenna of claim 8, wherein a power density in the bottom waveguide feeds into the top waveguide.

10. The antenna of claim 9, wherein the power density in the bottom waveguide feeds into the top waveguide through the coupling surface.

11. The antenna of claim 1, wherein the antenna elements are scattering antenna elements and the surface is a scattering surface.

12. The antenna of claim 11, wherein the scattering antenna elements are controlled and operable together to form a beam for the frequency band for use in holographic beam steering.

13. The antenna of claim 12, wherein the scattering antenna elements include a tunable slotted array of scattering antenna elements, and wherein the antenna elements in the tunable slotted array are positioned in one or more rings.

14. The antenna of claim 13, wherein each slotted array of scattering antenna elements comprises:

a plurality of slots;

a plurality of patches, wherein each of the patches is co-located over and separated from a slot in the plurality of slots, forming a patch/slot pair, each patch/slot pair being turned off or on based on application of a voltage to the patch in the pair; and a controller that applies a control pattern that controls which patch/slot pairs are on and off, thereby causing generation of a beam.

15. An antenna comprising:

antenna elements; and a guided feed wave source to provide a guided feed wave, wherein the guided feed wave source comprises a directional coupler to control vertical or lateral coupling of the guided feed wave to the antenna elements by changing power distribution of the guided feed wave to make the power distribution of the guided feed wave more uniform.

16. The antenna of claim 15, wherein the directional coupler is in between the guided feed wave source and antenna elements and separates the guided feed wave source and antenna elements.

17. The antenna of claim 16, wherein the directional coupler spatially filters the guided feed wave to provide a more uniform power density for the antenna elements than provided by the guided feed wave without filtering by the directional coupler.

18. The antenna of claim 17, wherein the guided feed wave is a high-power-density electromagnetic wave or a high-power-density, radially decaying electromagnetic wave.

19. The antenna of claim 16, wherein the directional coupler includes a coupling surface configured to a desired coupling rate or for optimized coupling curves for the antenna based on ordinary differential equations (ODE to change the power distribution of the guided feed wave in order to provide for a more uniform aperture distribution for the antenna than would be provided by the guided feed wave without changing the power distribution.

20. The antenna of claim 15, wherein the antenna includes a guided wave transmission line is to form an edge-fed cylindrical waveguide, a center-fed cylindrical waveguide, a linear waveguide, or a stripline transmission line.

* * * * *